US011002510B2

(12) United States Patent
Sitz

(10) Patent No.: US 11,002,510 B2
(45) Date of Patent: May 11, 2021

(54) FIREARM COMPONENT CARRIER

(71) Applicant: Justin C. Sitz, Bryan, TX (US)

(72) Inventor: Justin C. Sitz, Bryan, TX (US)

( * ) Notice: Subject to any disclaimer, the term of this patent is extended or adjusted under 35 U.S.C. 154(b) by 0 days.

(21) Appl. No.: 15/666,463

(22) Filed: Aug. 1, 2017

(65) Prior Publication Data

US 2018/0031351 A1 Feb. 1, 2018

Related U.S. Application Data

(60) Provisional application No. 62/369,633, filed on Aug. 1, 2016.

(51) Int. Cl.
*F41C 33/02* (2006.01)
*F42B 39/02* (2006.01)
*F41C 33/04* (2006.01)

(52) U.S. Cl.
CPC ..... *F41C 33/0236* (2013.01); *F41C 33/041* (2013.01); *F42B 39/02* (2013.01)

(58) Field of Classification Search
CPC ..... F41C 33/0245; F41C 33/0236; F41C 33/041; Y10S 224/912; A45F 2200/0591; A45F 5/00; A45F 2005/008; A45F 5/021
USPC ..... 224/183, 242, 243, 245, 911, 912
See application file for complete search history.

(56) References Cited

U.S. PATENT DOCUMENTS 1,046,912 A * 12/1912 Wanee ..... F41C 33/0236 224/243
1,166,781 A * 1/1916 Parrish ..... A45F 5/021 224/193
1,230,043 A * 6/1917 Shelton ..... F41C 33/0218 224/243
1,768,177 A * 6/1930 Wanee ..... F41C 33/0245 224/255
3,008,617 A * 11/1961 Villwock ..... F41C 33/0209 224/183
3,353,728 A * 11/1967 Freed ..... F41C 33/008 224/243
4,076,156 A * 2/1978 Katz ..... F41C 33/0227 224/243
4,325,506 A * 4/1982 Lindell ..... F41C 33/0227 224/243
4,471,894 A * 9/1984 Neely ..... F41C 33/0227 224/243
5,675,874 A * 10/1997 Chen ..... A41F 1/002 24/303
6,247,623 B1 * 6/2001 Walters ..... F41C 33/0236 224/255
6,427,374 B1 * 8/2002 Vaiani ..... F41C 23/02 119/770

(Continued)

FOREIGN PATENT DOCUMENTS

WO 2012141763 10/2012

*Primary Examiner* — Adam J Waggenspack
(74) *Attorney, Agent, or Firm* — Kunzler Bean & Adamson, PC

(57) ABSTRACT

A firearm component carrier apparatus is disclosed. The firearm component carrier apparatus is disclosed. The apparatus includes a main body, an insert member, and a wrap member. The insert member is coupled to the main body and is oriented to insert into a firearm component. The wrap member is coupled to the main body. The wrap member is shaped to wrap at least partially around the firearm component to secure the firearm component relative to the main body.

18 Claims, 46 Drawing Sheets

(56) References Cited

U.S. PATENT DOCUMENTS

| | | | | |
|---|---|---|---|---|
| 6,502,727 | B1 * | 1/2003 | Decoteau | A45F 5/004 224/162 |
| 6,530,508 | B1 * | 3/2003 | Devine | A45F 5/00 224/183 |
| 6,616,020 | B1 * | 9/2003 | Spielberger | F41C 33/0245 224/183 |
| 7,246,384 | B2 * | 7/2007 | Bentz | A42B 3/08 2/421 |
| 8,322,586 | B2 * | 12/2012 | Davis | A45F 5/021 224/669 |
| 8,403,132 | B2 * | 3/2013 | Moreau | B65H 75/364 206/234 |
| 9,182,205 | B2 | 11/2015 | Sitz | |
| 9,261,328 | B2 | 2/2016 | Sitz | |
| 9,581,421 | B2 * | 2/2017 | Sitz | F42B 39/08 |
| 9,930,956 | B2 * | 4/2018 | Dannan | A45F 5/021 |
| 2012/0181318 | A1 * | 7/2012 | Mongan | A45F 5/021 224/665 |
| 2012/0255979 | A1 * | 10/2012 | Sitz | F41A 23/18 224/243 |
| 2013/0119098 | A1 * | 5/2013 | Stiefel | A45F 5/02 224/183 |
| 2013/0327799 | A1 * | 12/2013 | Sitz | F41A 23/18 224/243 |
| 2016/0076852 | A1 * | 3/2016 | Liu | F41C 33/0209 224/587 |
| 2016/0106227 | A1 * | 4/2016 | Ng | A47D 13/025 135/65 |

* cited by examiner

FIREARM COMPONENT CARRIER

CROSS-REFERENCES TO RELATED APPLICATIONS

This application claims the benefit of U.S. Provisional Patent Application No. 62/369,633 entitled "SYSTEM TO CARRY FIREARM OR MAGAZINE" and filed on Aug. 1, 2016 for Justin C. Sitz, which is incorporated herein by reference.

FIELD

This invention relates to holsters and more particularly relates to holsters for carrying a firearm component.

BACKGROUND

A holster is a structure to carry an object. In some cases, holsters may be made for or used to carry a firearm component such as a firearm, a magazine, ammunition, or other equipment associated with a firearm. Generally, holsters serve to hold the firearm component in a position relatively accessible for a user.

SUMMARY

A firearm component carrier apparatus is disclosed. The apparatus includes a main body, an insert member, and a wrap member. The insert member is coupled to the main body and is oriented to insert into a firearm component. The wrap member is coupled to the main body. The wrap member is shaped to wrap at least partially around the firearm component to secure the firearm component relative to the main body.

A firearm carry system is also disclosed. The firearm carry system includes a main body, a wrap member, and a magnet. The wrap member is coupled to the main body. The wrap member is shaped to wrap at least partially around the firearm. The magnet is coupled to the wrap member. The magnet is aligned to secure the firearm relative to the main body.

A firearm component holster is also disclosed. The firearm component holster includes a main body, an insert member, and a wrap member. The main body includes a fastening device coupled to a first end of the main body. The insert member is coupled to a second end of the main body opposite the first end. The wrap member is coupled to the main body between the first end and the second end. The wrap member includes a magnet to secure the firearm component relative to the main body.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
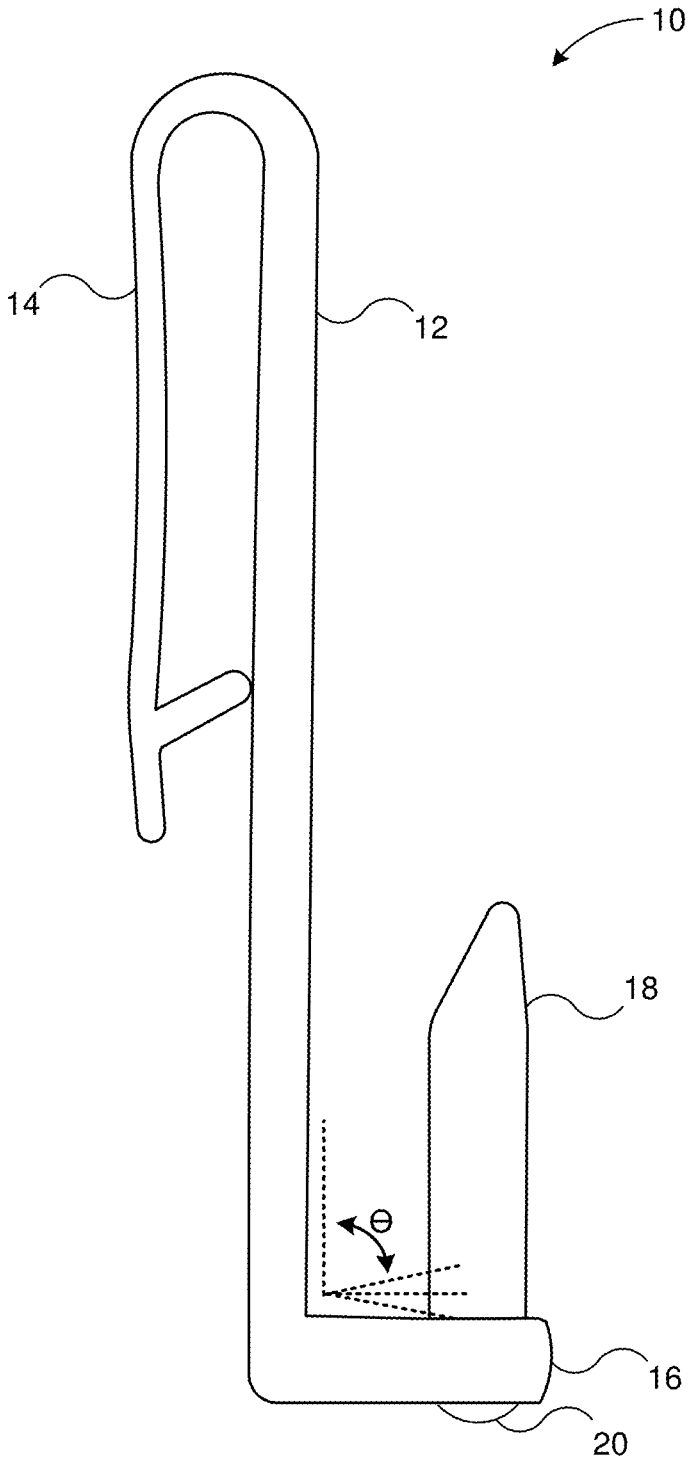
FIG. 1A is a side view illustrating one embodiment of a main body assembly.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

Carrying or maintaining a firearm or firearm component accessible may introduce many obstacles which can arise during the day when it comes to carrying on his or her person, vehicle, or elsewhere. When carrying a firearm component, it can be advantageous to have a simple and lightweight method for effectively and securely caring a firearm. Often when carrying a firearm in a traditional holster, it can be problematic to install and uninstall a holster throughout a user's day to day activities. When carrying a firearm, a user should be aware of locations in which a firearm can lawfully be carried and which locations in which a firearm cannot be lawfully carried. This can result in installing and uninstalling a firearm and holster from a user's waist, vehicle, and other surfaces multiple times throughout the day. Furthermore, this device remedies the common problem of not being able to find the correct holster for a specific firearm. Traditional holsters focus solely on the external features of the firearm to create adequate friction to carry a firearm securely.

As described herein, the term firearm component refers to at least one of a firearm, a portion of a firearm such as a magazine or clip, ammunition or a structure for organizing ammunition, or an accessory to accompany or be attached to a firearm such as a laser light, a flashlight, a scope, etc.

As described herein, a single holster may be utilized to work across multiple firearms not sharing the same common external features. The holster described herein also allows for quicker break-in compared to traditional holsters. For example, a traditional holster which uses external features to grab the firearm may take an extended amount of time to break-in and achieve an acceptable draw tension. The holster described herein does not require the traditional break-in time. A user will benefit greatly from having one holster not requiring a break-in period, that can work with multiple firearms, firearms with lasers, firearms with lights, and any other attachments for firearms. Furthermore, this versatility offers benefits to the manufacturer and end retail distributor alike lowering the number of model variations to be carried or produced.

In some implementations, the holster described herein may be constructed that is specific to particular types or model. For example, a variation could be built to specifically fit a Glock® brand firearm, with key features of the corresponding firearm component present in the holster.

The holster described herein simplifies obstacles encountered daily by any user wishing to carry a firearm, magazine, flashlight, or other component on his or her person, vehicle, or elsewhere in which it is advantageous to have that firearm component attached/available. When carrying a firearm magazine, it can be advantageous for a user to have a simple and lightweight method for effectively and securely carrying a firearm component. Often, when carrying a firearm component in a traditional holster, it can be problematic to install and uninstall a holster throughout a user's day-to-day activities. When carrying a firearm component, a user should be aware of locations in which a firearm component can lawfully be carried compared to locations in which a firearm component cannot be lawfully carried. This can result in installing and uninstalling a firearm component and holster from a user's waist, vehicle, and other surfaces multiple times throughout the day. Furthermore, this device remedies the common problem of not being able to find the correct holster for a specific firearm component. Traditional holsters may rely on the external features of the firearm component to create adequate friction to carry a firearm component securely.

Also described herein is a holster that may be used for multiple firearm components not sharing the same common external features. The holster also allows for quicker break-in over traditional holsters, whereas a traditional holster which uses external features to retain the firearm component, can take an extended amount of time to break-in and achieve an acceptable draw tension. This device does not require the traditional break-in time. A user will benefit greatly from having one holster not requiring a break-in period, that can work with multiple firearm components. Furthermore, this versatility offers benefits to the manufacturer and end retail distributor alike lowering the number of model variations to be carried or produced.

In some implementations, the holster described herein may be constructed that is specific to particular types or model. For example, a variation could be built to specifically fit a Glock® brand magazine, with key features of the Glock magazine catch being present in the holster.

A holder is described that is usable to secure a firearm, magazine, clip, or other component which includes a body having a first portion with a member usable for insertion into the barrel or other structure of a firearm, magazine, or other firearm component to stabilize the firearm component. A portion or member for securing the holder to a surface, a waistline, clothing, belt, vehicle, and any area desirable to secure a firearm component. Methods of securing can include but not limited to, friction, angled members, dimensional tolerances, gravity, magnetics, adhesives, hook and loop attachments, and other manners suitable for attachment. A member that extends from the body to cover additional areas of the firearm component. The firearm component can be stabilized against movement relative to the body by friction created from angled members, dimensional tolerance, gravity, magnetics, adhesives, hook and loop attachments, and commonly known methods. Prevention of undesirable contact with the firearm, magazine, or clip can be achieved by, but not limited to, an extending member or members that cover areas of the firearm component. Any member and/or members is not limited to, but could be constructed of a flexible material, and secured by angled members, dimensional tolerance, gravity, magnetics, adhesives, hook and loop attachments, and commonly known methods. A holder such as this is beneficial in minimizing bulk, and enabling a variety of firearms, magazines, or clips to be carried easily.

FIG. 1A is a side view illustrating one embodiment of a main body assembly 10. The main body assembly 10 includes multiple parts and features. The main body 12 is rectangular and conforms to the side of the firearm, note this shape is one of many possible shapes the main body 12 could be built in. Such shapes could include cylindrical, square, triangular, U-shaped, and any other shape. For example, a revolver has a conical shape and in this variation a conical shaped main body 12 could be used. The positioning of the main body against the side of the firearm could also be altered to any area around the firearm. The main body 12 has two dovetail slots located on the back side, these slots serve the purpose of allowing a secondary member to attach to the main body 12. This device is not limited to this location or attachment style; it could also be constructed without the attachment slots. The main body 12 could be built of many materials such as, plastic, metal, leather, 3-D printing, and any other material available. The main body 12 pictured is molded of plastic, with a feature at one end 14 for attaching the main body to a person's waistline, and a base flange 16 at the opposite end.

The feature 14 could be built of many materials, and built to attach to various other surfaces such as but not limited to, walls, vehicles, military vest or plate carrier, and furniture. This feature 14 could also be built in a way to allow multiple variations of 14 to install and uninstall from the main body 12. This feature 14 could be built as one piece with the main body 12, or as an independent component which could be attached to the main body 12 in various methods. If this feature 14 was an independent component it could be attached in a method allowing the angle in relation to the main body 12 to be altered. Furthermore, the attachment could allow for variations in the overall length of the main body.

At the opposing end of the main body is a flange 16 set at an angle Θ in relation to the main body 12. In the illustrated embodiment, the angle Θ is 90°. In other embodiments, the angle Θ is less than or greater than 90°. For example, the angle Θ may be acute or less than 90° to apply a flexure force to a firearm component. In another example, the angle Θ may be obtuse to facilitate greater ease of accessing the firearm or introducing the firearm component into the assembly 10. Attached to flange 16 is an insert member 18 intended to be inserted into a firearm's barrel.

In some embodiments, insert member 18 is conical, but could be flat, square, rectangular, triangular, and a multitude of other designs. Insert member 18 could also be constructed to work with a mechanical fastener to change dimensions as the fastener is engaged with insert member 18. For example, insert member 18 could be constructed with a hollow core that is drafted to a decreasing diameter the deeper it runs into member 18. Upon inserting a fastener to varying depths member 18 would increase or decrease its overall dimension. This is one of many methods to create a member 18 that can vary in dimension. Member 18 is attached the flange 16 by a fastener 20, but could be built as one piece with the main body 12. The acute angle could be achieved in other ways, such as bottom flange 16 at a perpendicular angle to the main body 12, and having the member 18 constructed to create an acute angle in relation to the main body 12. The current design uses the acute member angle at which member 18 is oriented to create friction inside the firearm's barrel. As the member 18 is inserted into the firearm barrel it forces the side of the firearm against the main body 12. Friction inside the firearm barrel could be increased and decreased by altering the base flange 16 angle, or altering member 18. The ability to increase or decrease tension would be beneficial to the end user. Some methods of achieving this would be multiple members 18 constructed at varying angles, multiple flanges 16 at varying angles, an adjustable flange 16, or adjustable member 18 This design could be altered to stabilize a firearm without an acute angle in relation to the main body 12, bottom flange 16, or member 18.

Other methods of creating friction with an insert member 18 parallel to the main body 12 are anticipated using dimensional tolerances comparative to the firearm being carried.

Another embodiment uses positive features on the main body 12 to contact negative areas on the firearm being carried. This engagement creates stability while using a main body 12, bottom flange 16, and member 18 that did not equal an acute angle when joined together.

Another embodiment uses magnets incorporated into the main body 12 to create stability when attached to a firearm. In this embodiment, the member 18 and 16 can incorporate a range of angles while creating sufficient stability when attached to a firearm. In some embodiments, the magnets correspond to a magnetic portion of the firearm component. In some embodiments, the magnets correspond to a magnet attached or otherwise applied to the firearm component.

Figure 1B:
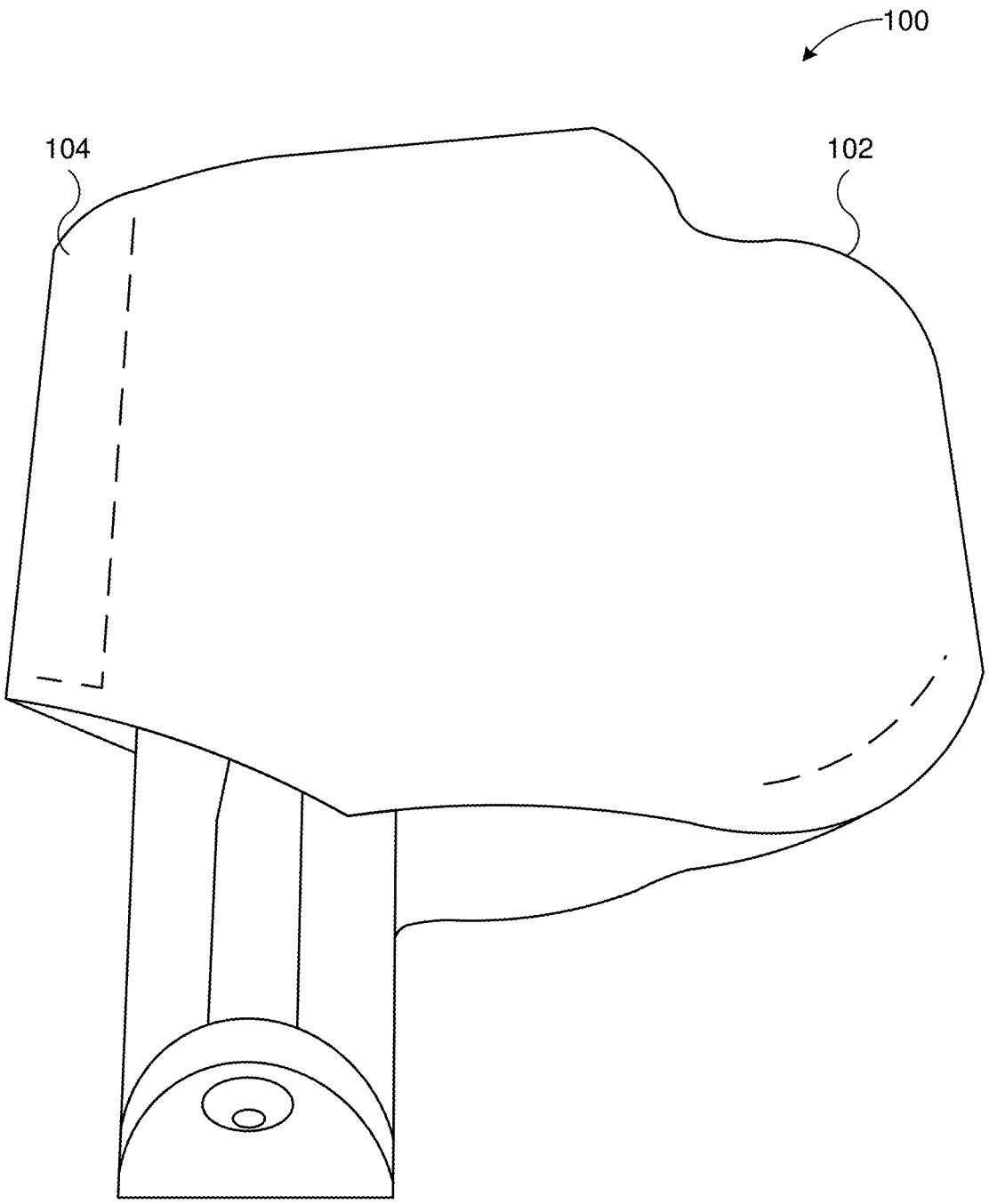
FIG. 1B is a perspective view of one embodiment of a front side of the main body assembly with a wrap member attached.

FIG. 1B is a perspective view of one embodiment of a front side of the main body assembly with a wrap member 102 attached. The member 102 is intended to wrap around the exposed portion of the firearm. Note the shape of the member is not limited to the shape show, and is merely a representation of one of many shapes that might be used. For example, when used with a revolver a U-shaped design could be used. The member is made of leather and is slightly flexible in nature, however note that the member could be constructed of many other materials such as, nylon, elastic, cotton, plastic, and any other material available. For example, member 102 could be constructed of plastic such as FIG. 40 4002. Member 102 could also be constructed using a combination of materials such as leather and elastic.

Combining multiple materials can allow for greater versatility across size and fitment within multiple firearms. For example, elastic could be attached between two halves of member 102 such as in FIG. 21 2102. Furthermore, it is to be understood that the member 102 does not have to be flexible in nature, and might be built of a partially or full rigid material. For example, member 102 could be molded of plastic, or 3-D printed. Such an example can be seen in FIG. 42 4202. Member 102 serves as a guard to features on a firearm that are intended to remain untouched while holstered. Such features may include but are not limited to the trigger, trigger guard, slide release, cylinder, magazine release, slide serrations, and any other sharp or unwanted feature.

Member 102 also serves to prevent unwanted trash, debris, sweat, liquids, and other unwanted materials out of the firearm's internal components. Keeping unwanted trash out of a firearm can be a benefit in both semi auto types and revolver types. For example, if foreign material builds up in between a firearm's cylinder in revolver type firearms, the cylinder can be prevented from moving freely. It should be known that this disclosed device is intended for use on semi auto and revolver firearms. Furthermore, member 102 provides stability and retention, this could be achieved solely with member 102 or in conjunction with multiple members within the main body assembly (FIG. 1A).

Member 102 is intended to work across multiple firearms, and the general design allows it to wrap effectively around all firearms. Member 102 is not limited to being joined at only one side of the main body 12 or in the location show. For example, member 102 could be constructed as one piece or multiple pieces connected at two location points on the main body 12. Member 102 is not limited to the horizontal axis of the main body 12 and could be constructed across the vertical access, or any axis of the main body 12.

Figure 27:
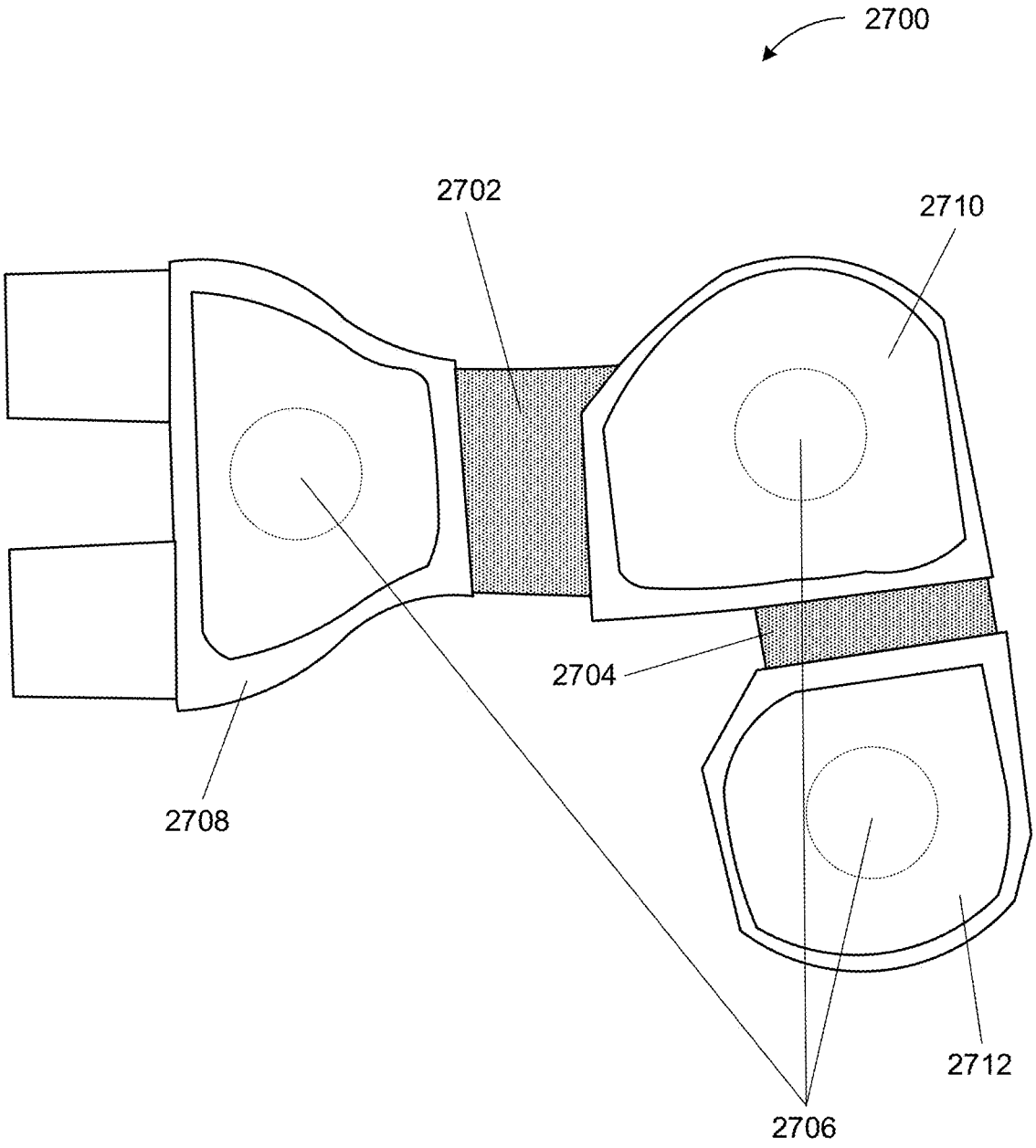
FIG. 27 shows one embodiment of a wrap member that can be folded across multiple axis to make attaching it to a firearm easier.

It should be understood that the design is not limited to only shapes that will work across multiple firearms, but could also be built to a model specific design. For example, a model could be constructed with molded features within member 102 such as FIG. 18 1802. Member 102 in the example shown is one piece sewn, in a folded configuration to fit multiple firearms, however note that member 102 could be constructed of multiple pieces, and of multiple material types, and multiple material dimensions. For example, elastic, nylon, cotton, or other materials can be used to join components of member 102 such as shown in FIG. 27 2702.

The process of construction of member 102 is not limited to sewing, and could be molded, 3-D printed, ultrasonic welded, joined adhesive, and other methods. Furthermore, it should be known that the shape of member 102 is not limited to the shape shown. For example, shapes such as rectangles, squares, circles, and other shapes can be used. One method of holding member 102 in place while the device is in use is through magnets. By utilizing magnets, the overall dimension of 102 can be constructed in a way to achieve less friction from griping the externals of the firearm, and in turn rely on the magnets as a retention point. This creates a device that does not require a break-in period of time, as opposed to traditional holsters which do require time for the material to stretch.

The member 102 features a pocket 104 sewn into the material for housing magnets. Please note the magnets are not limited to this one location, and this location and design is just one of many effective locations and designs. The magnets in location 104 are intended to keep the material attached to the firearm and create friction. Member 102 could also be built without magnets and secured in other acceptable methods. One possible method would be to use a flexible steel core which would allow the member 102 to flex on and off the firearm.

Figure 34:
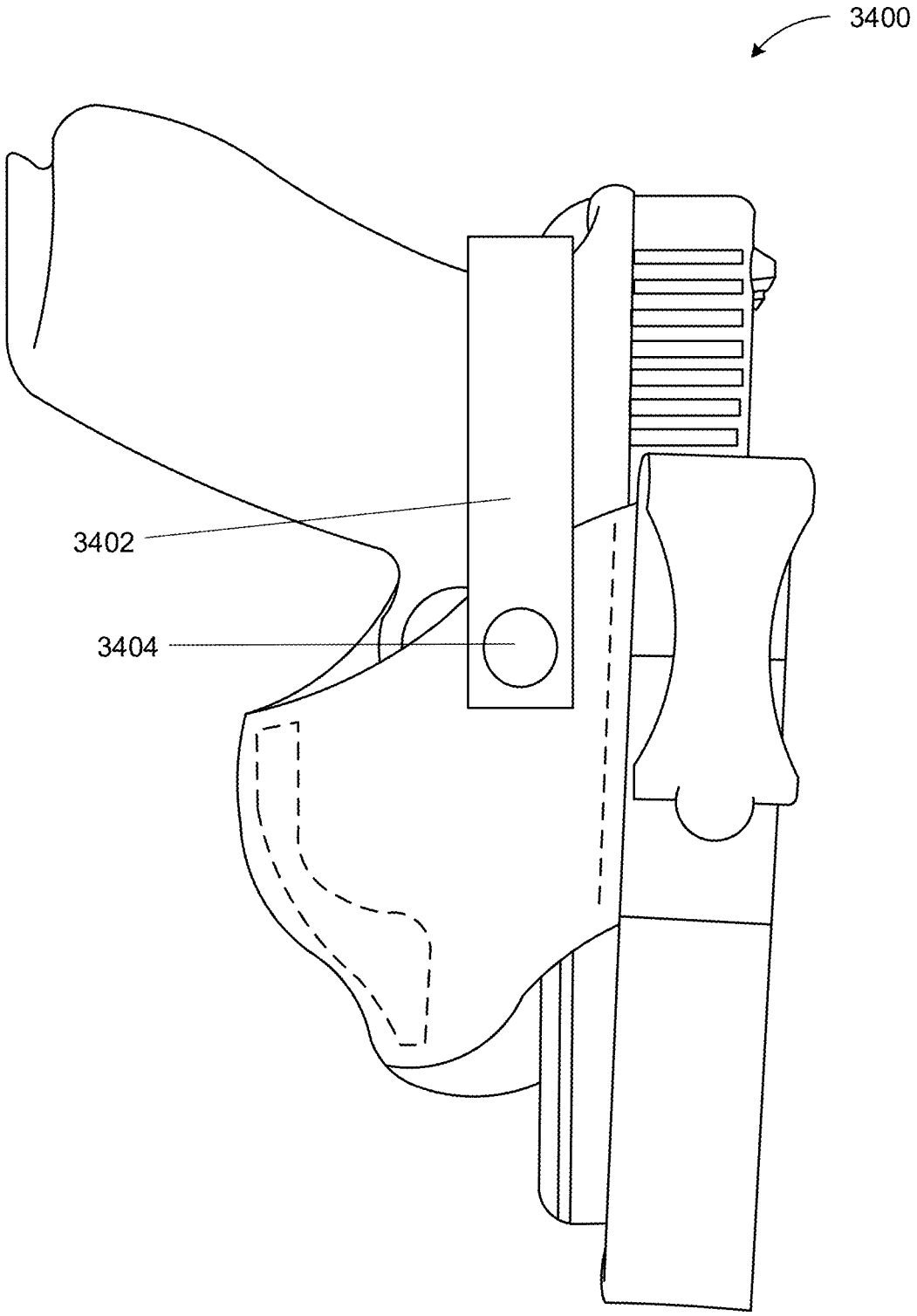
FIG. 34 shows another embodiment of back side view of a wrap member with a holding member for preventing movement of the firearm.
Figure 35:
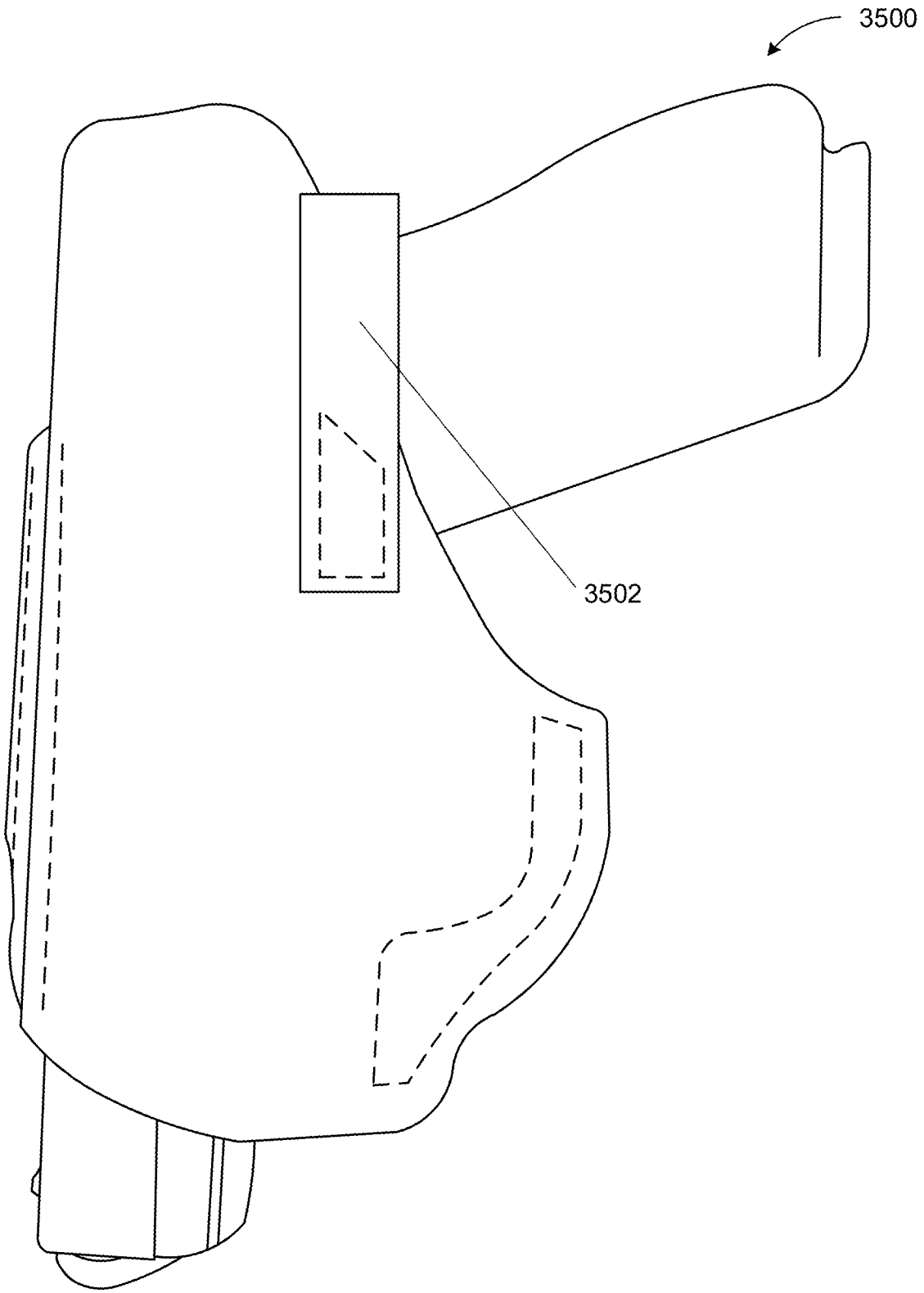
FIG. 35 shows one embodiment of a front side view of the system of FIG. 34.

Member 102 could also be constructed with adhesive, hook and loop attachments, buckles, snaps, magnets, and other methods to secure itself to the firearm. Member 102 could be constructed with a strap running around another opposing axis of the firearm, requiring the end user to manipulate it prior to removing the firearm. In this case member 102 could become a locking device to prevent accidental removal of a firearm by the user, or another person. For example, FIGS. 34 and 35 show one of many possible methods with a strap 3402 attached to member 102 at location 3404.

Figure 2:
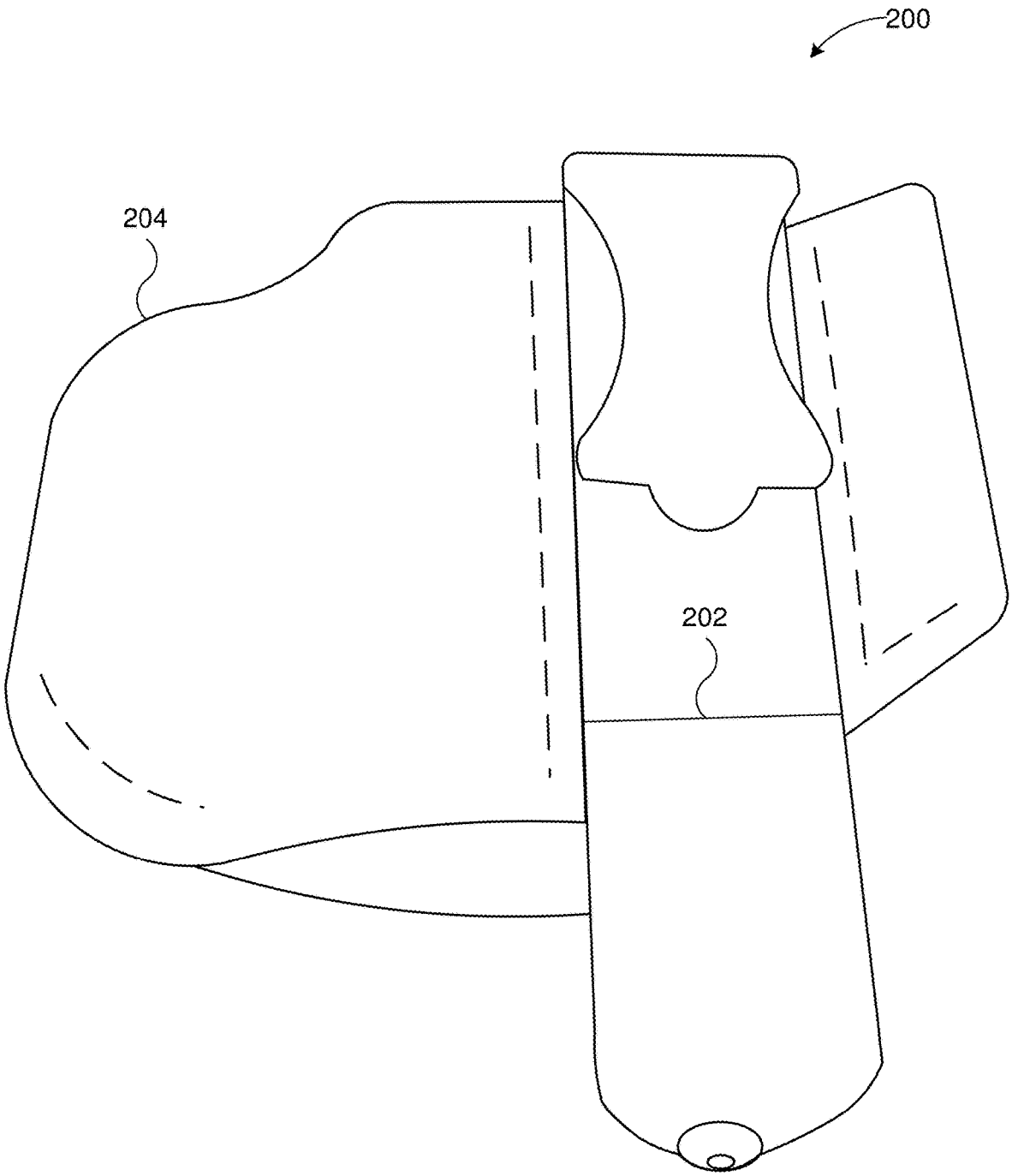
FIG. 2 is a perspective view of one embodiment of a back view of the main body assembly with a wrap member attached.

FIG. 2, is a perspective view of one embodiment of a back view of the main body assembly with a wrap member 102 attached. Joint 202 shows a joint for attaching member 102 to the main body 12. This joint could be constructed in many configurations and not limited to the dovetail joints shown. Constructed with one or multiple joint/s in this location of the main body assembly allows for many benefits. Such as, easy of construction, it is much easier to create member 102 independent from the main body assembly. It also allows the same main body assembly to be paired with multiple members 102. Under a jointed construction member 102 could be oriented on either side of the main body 12 allowing for variations of firearms and carry orientations. The joint could also be constructed in a manner allowing it to alter the distance between member 102 and the main body 12. The dovetail joint shown is created with male and female locking features inside the dovetail, note this could be built with other locking features, or without any locking feature. It should be understood that this device is not limited to having this joint/s, type of joint/s, and could be built without a joint/s. In this embodiment, the main body 12 and member 102 could be formed together and of the same material. Element 204 is the backside of member 102.

Figure 3:
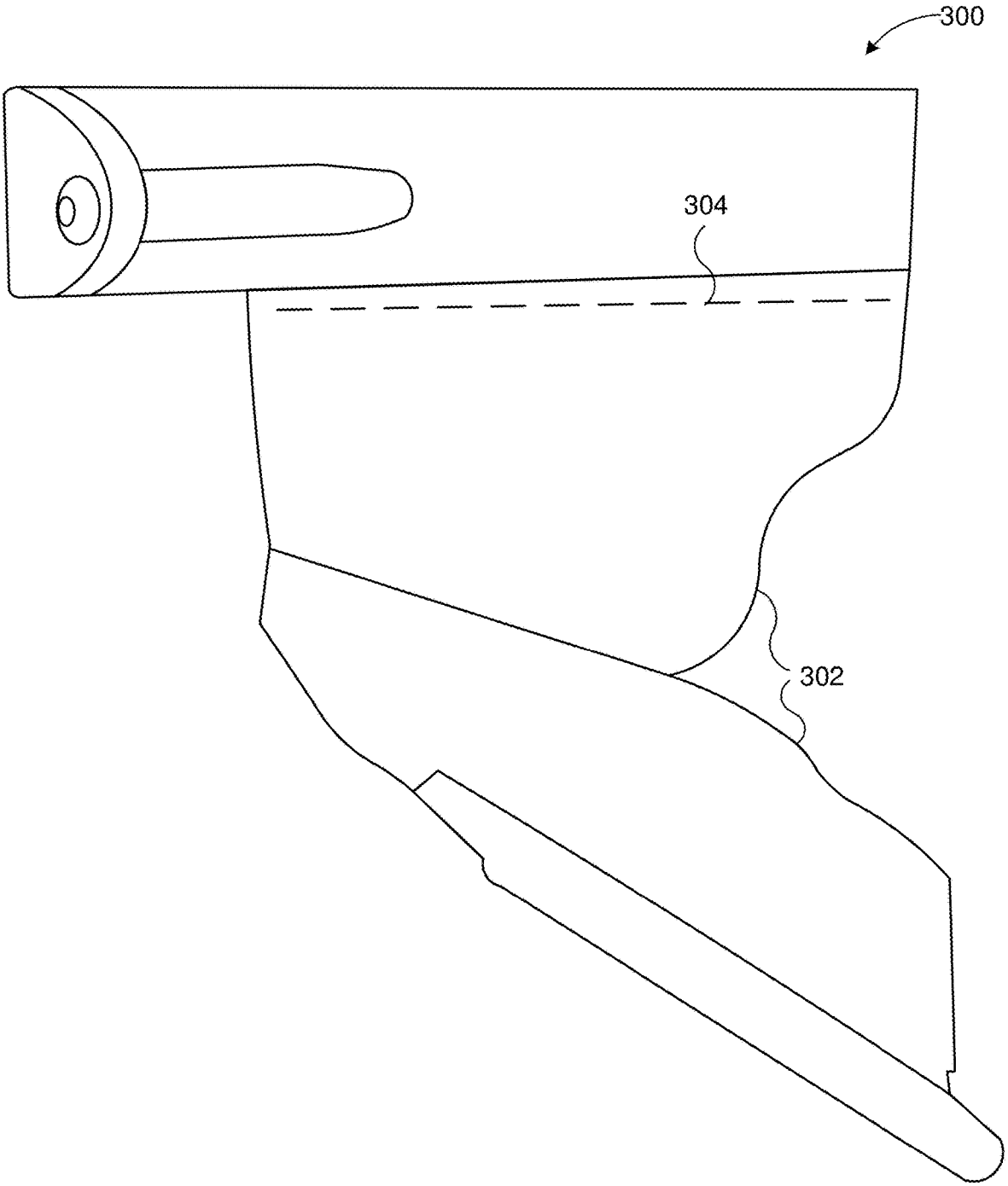
FIG. 3 is a perspective view of one embodiment of an interior of the wrap member on a front side of the body assembly.
Figure 21:
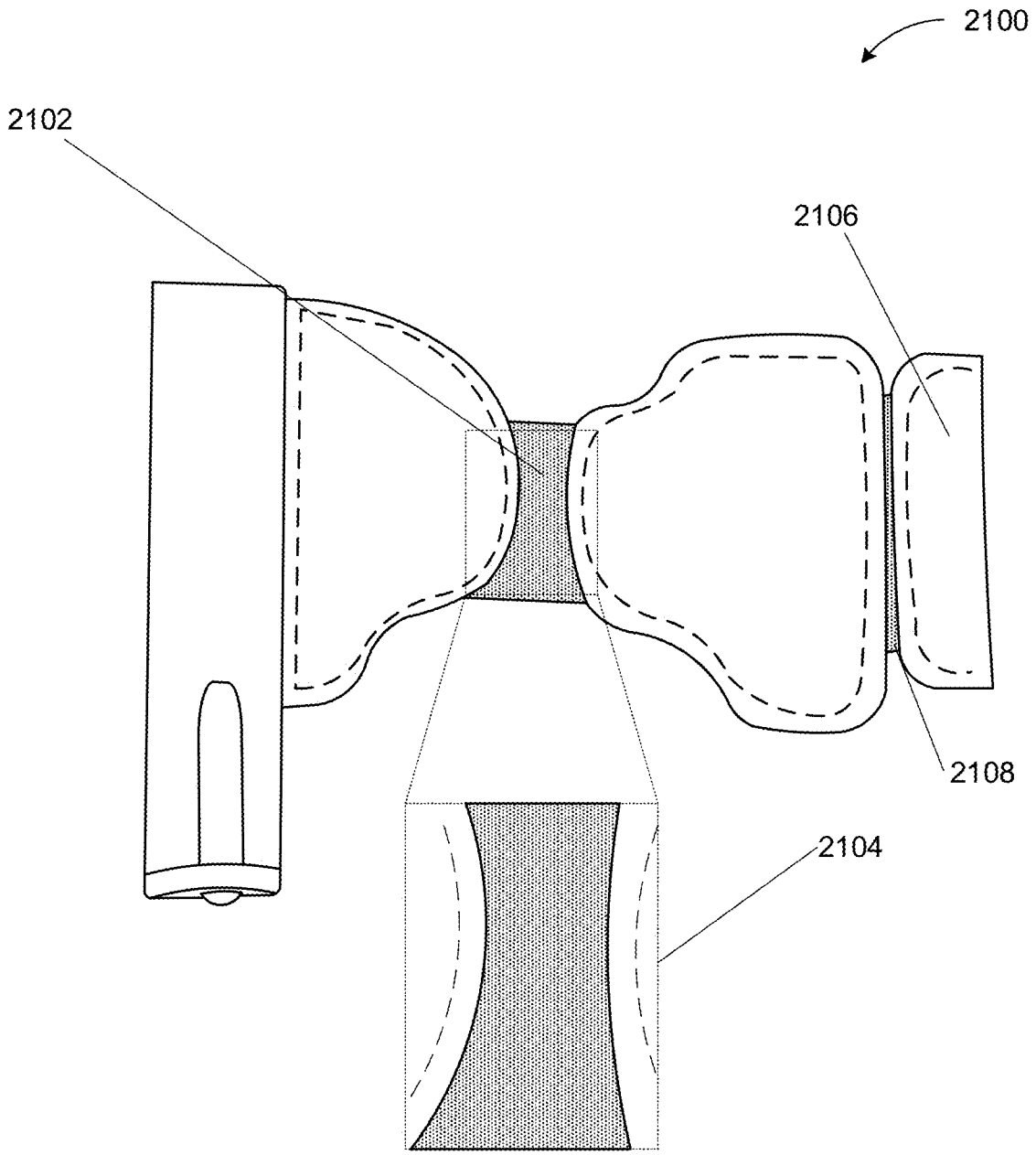
FIG. 21 shows another embodiment of a wrap member without the joint included in FIG. 17.

FIG. 3 is a perspective view of one embodiment of an interior of the wrap member 102 on a front side of the body assembly 12. In this embodiment, element 302 identifies the two halves of member 102 opened in a manner to accept insertion of a firearm. Member 102 is not limited to pivoting open on the particular axis line shown, and this is merely one of many pivoting axis locations that could be used. In some embodiments, the pivoting location shown is centered under the trigger guard on a firearm. In some embodiments, this location creates less bulk and irritation with a user's side. This location is shown of like material in which member 102 is constructed of, but it could be made of other materials as well, such as elastic, nylon, plastic, cotton, or any other material suitable for construction. Use of materials in this location such as elastic allows further versatility across firearm, laser, and light combinations. For example, FIG. 21 2102 shows pivoting locations made of elastic allowing the joint to stretch and flex. It is to be understood that member 102 may be built to accept multiple materials and size configurations in a modular setup allowing the user to vary friction and internal dimensions.

Location 304 shows a location at which member 102 is attached to the dovetail joint. In this configuration, the material that member 102 is constructed of is sewn to a plastic material molded in the shape of a dovetail joint. Embodiments described herein are not limited to sewing as a means of attaching, nor is the dovetail joint limited to being made of plastic. Such examples are merely one possibility for construction. Other methods might include molding the combination of member 102 and the dovetail joints as one piece, or molding member 102 and main body assembly 12 as one piece.

Figure 4:
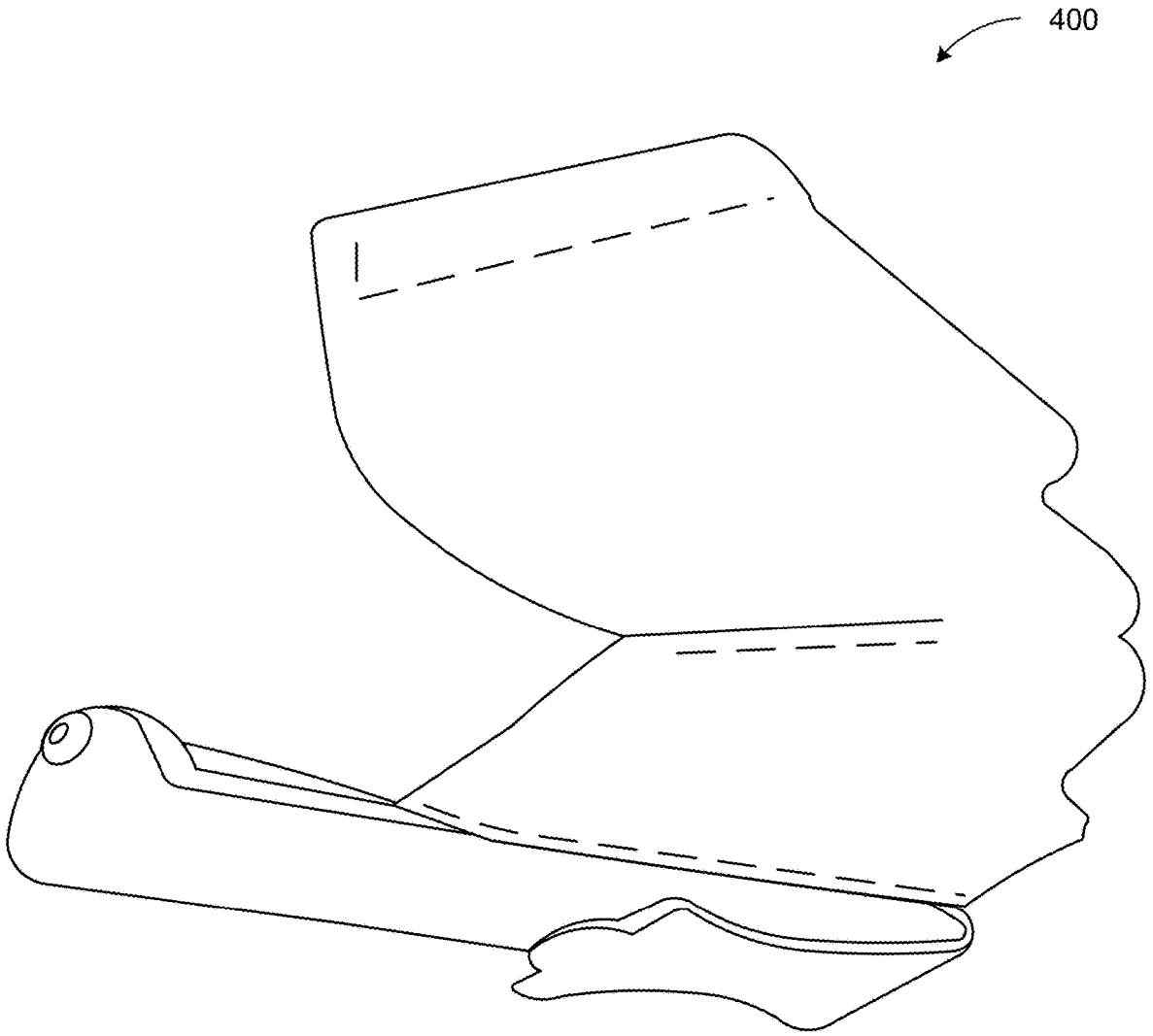
FIG. 4 illustrates a perspective view of one embodiment of an exterior of the wrap member on a back side of the main body assembly.
Figure 5:
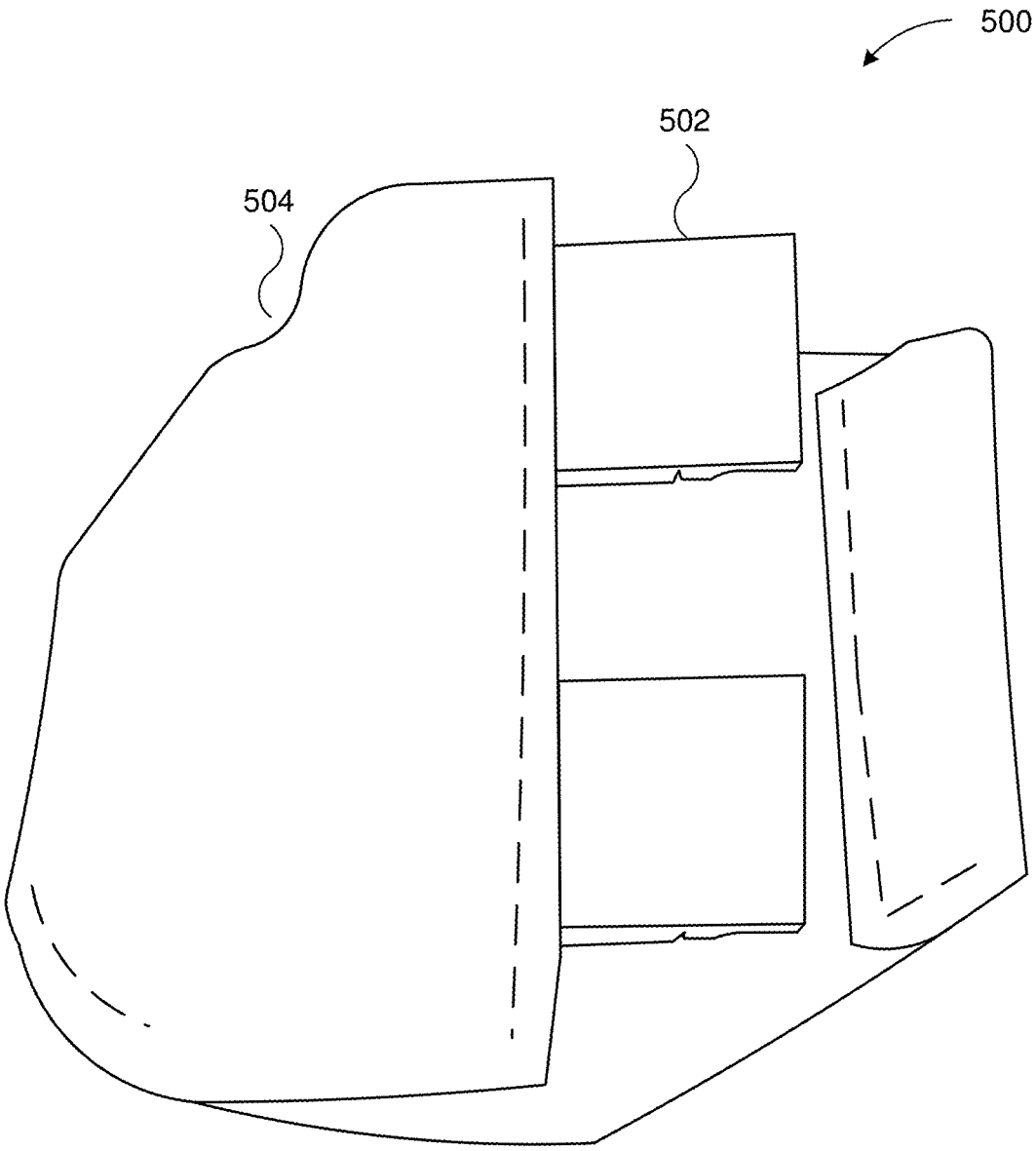
FIG. 5 is a perspective view of one embodiment of a front side of a wrap member unattached to a main body assembly.

FIG. 4 illustrates a perspective view of one embodiment of an exterior of the wrap member on a back side of the main body assembly. FIG. 5 is a perspective view of one embodiment of a front site of a wrap member 102 unattached to a main body assembly 12. The dovetail joint member 202 represented in FIG. 5 as 502 has been sewn to member 102, but could be constructed in other methods. The dovetail joint 502 has a locking feature so that it remains firmly installed into the main body when inserted. It should be known that this device is not limited to a locking feature and could be constructed without such a feature.

Cutout 504 notates a special cut in the design to allow clearance for a firearm's magazine release button. This cut eliminates accidental magazine release when carrying a firearm. The design of member 102 is not limited to having a relief cut for a magazine release button, and could have no relief cut. Furthermore, member 102 could have multiple relief cuts, or a relief cut for the cylinder release button on a revolver style firearm.

Figure 6:
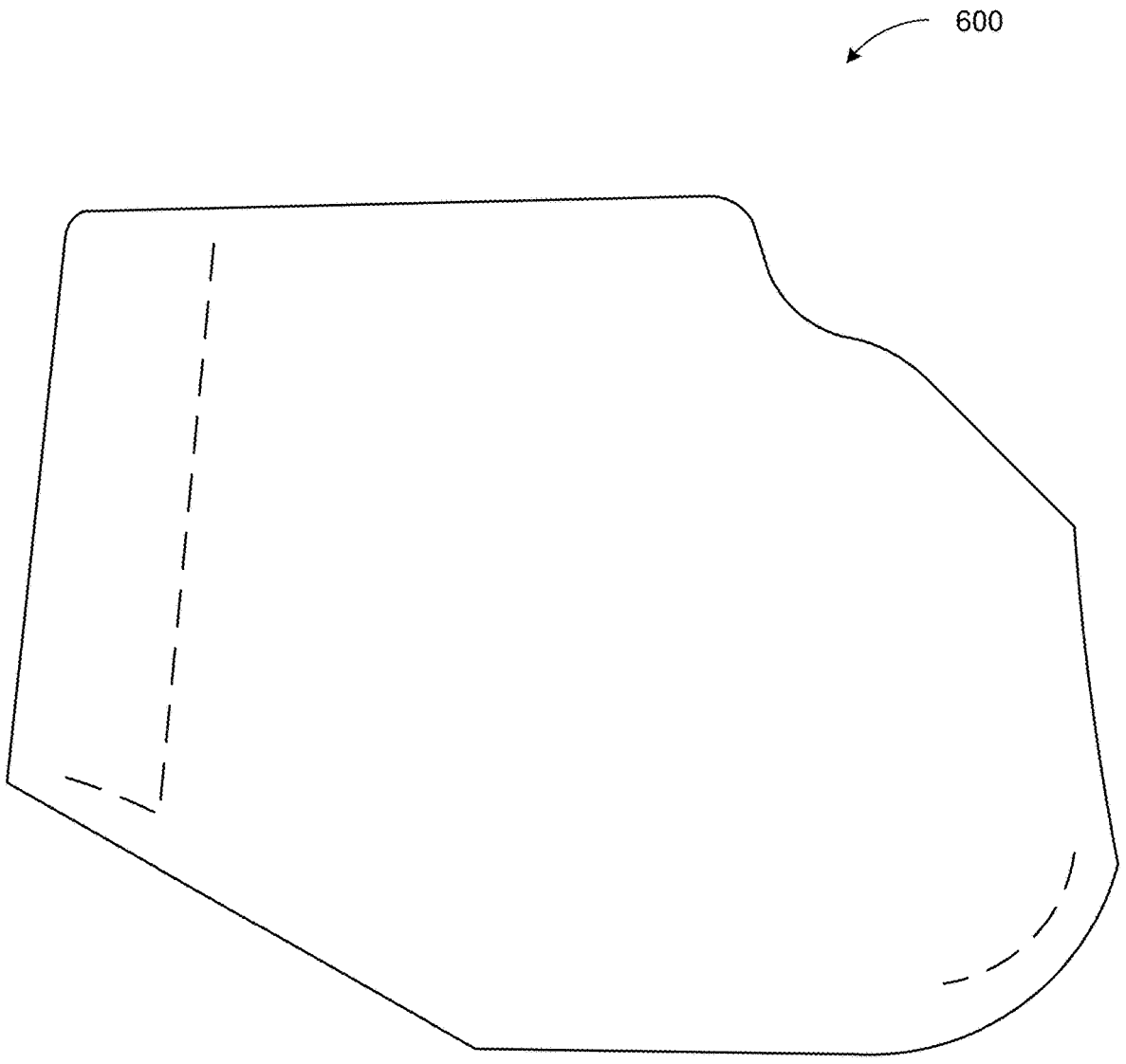
FIG. 6 shows a perspective view of one embodiment of a back side of a wrap member unattached to a main body assembly.
Figure 7:
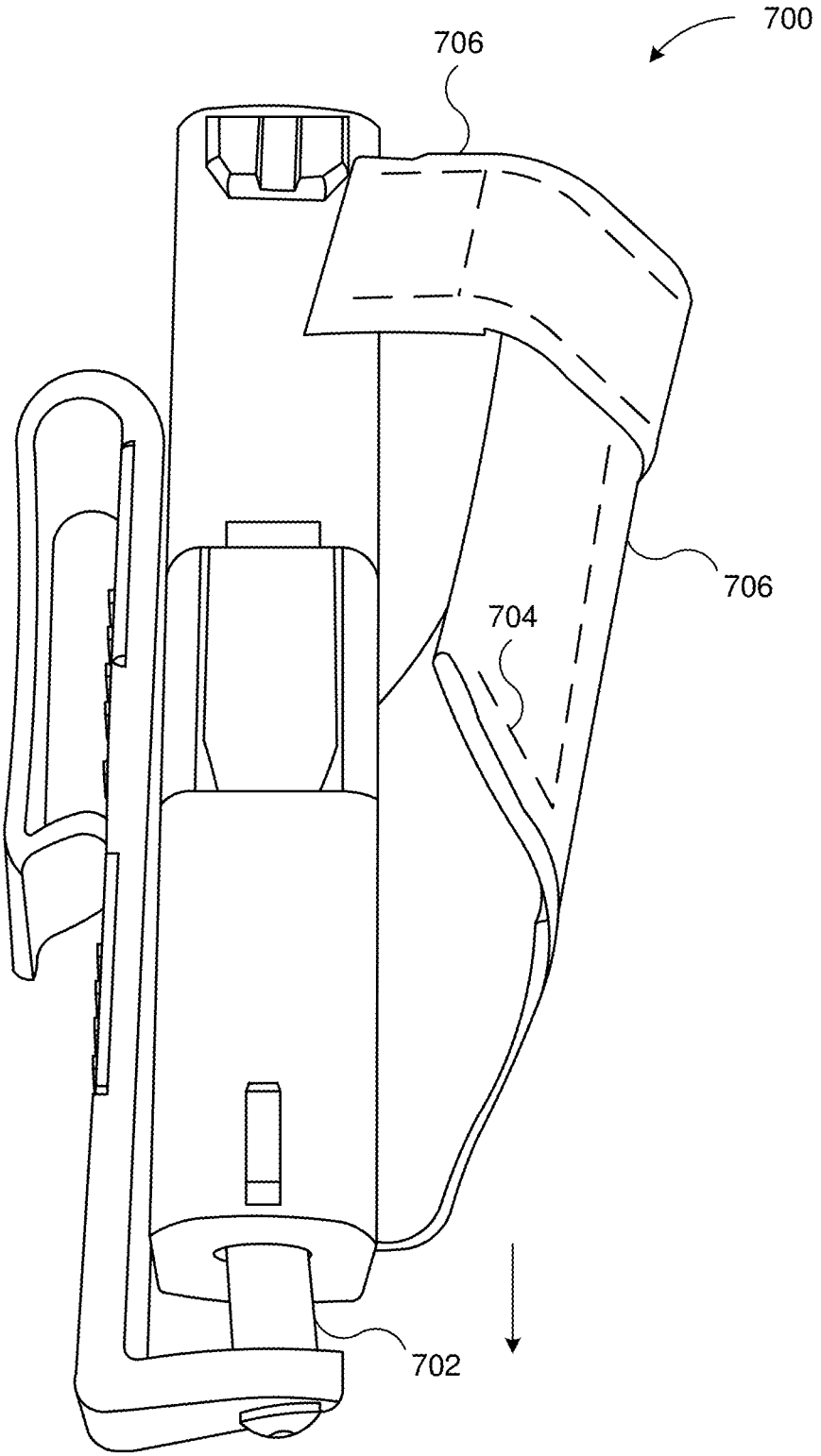
FIG. 7 illustrates a perspective view of another embodiment of a side view of a firearm component carrier partially engaged with a firearm.

FIG. 6 shows a perspective view of one embodiment of a back side of a wrap member 102 unattached to a main body assembly. FIG. 7 illustrates a perspective view of another embodiment of a side view of a firearm component carrier partially engaged with a firearm. Insert member position 702 shows insert member 16 flexing open away from the main body 12 as the firearm is slid onto member 16. Wrap member position 704 shows member 102 moving towards the main body 12 to cover exposed areas of the firearm.

Wrap member 706 shows a variation of wrap member 102 with multiple magnets embedded in multiple locations. It is to be noted that these locations are not limited to the exact locations show. This variation of member 102 shows magnets that will come to rest on multiple areas of the firearm. Multiple locations can serve to create greater retention, make sure that member 102 is correctly positioned on the firearm, and other benefits. This design could also be built with interchangeable magnets allowing for increases and decreases to the magnetic pull. Member 102 could also be constructed with one magnet as opposed to multiple magnets. Furthermore, member 102 could be built with no magnets and remain secure through other methods. For example, a version of member 102 could be attached at two locations on the main body assembly 12. A version of member 102 attached at opposing sides of the main body assembly 12 can be seen in FIG. 49 4202.

Unlike traditional holsters that are fully connected, FIG. 7 shows how the disclosed device can pivot open allowing for friction when fully enclosed and limited friction when fully opened. The ability to open creates a design that does not require a break in period of time such as with traditional holster designs and materials. In traditional designs, the user has to spend time stretching and manipulating the material to achieve the correct amount of retention. Under the disclosed design the right amount of tension can be achieved immediately. This design is not limited to being disconnected at one or multiple locations on the main body assembly 12. For example, FIG. 46 shows a fully connected version of member 102.

Figure 8:
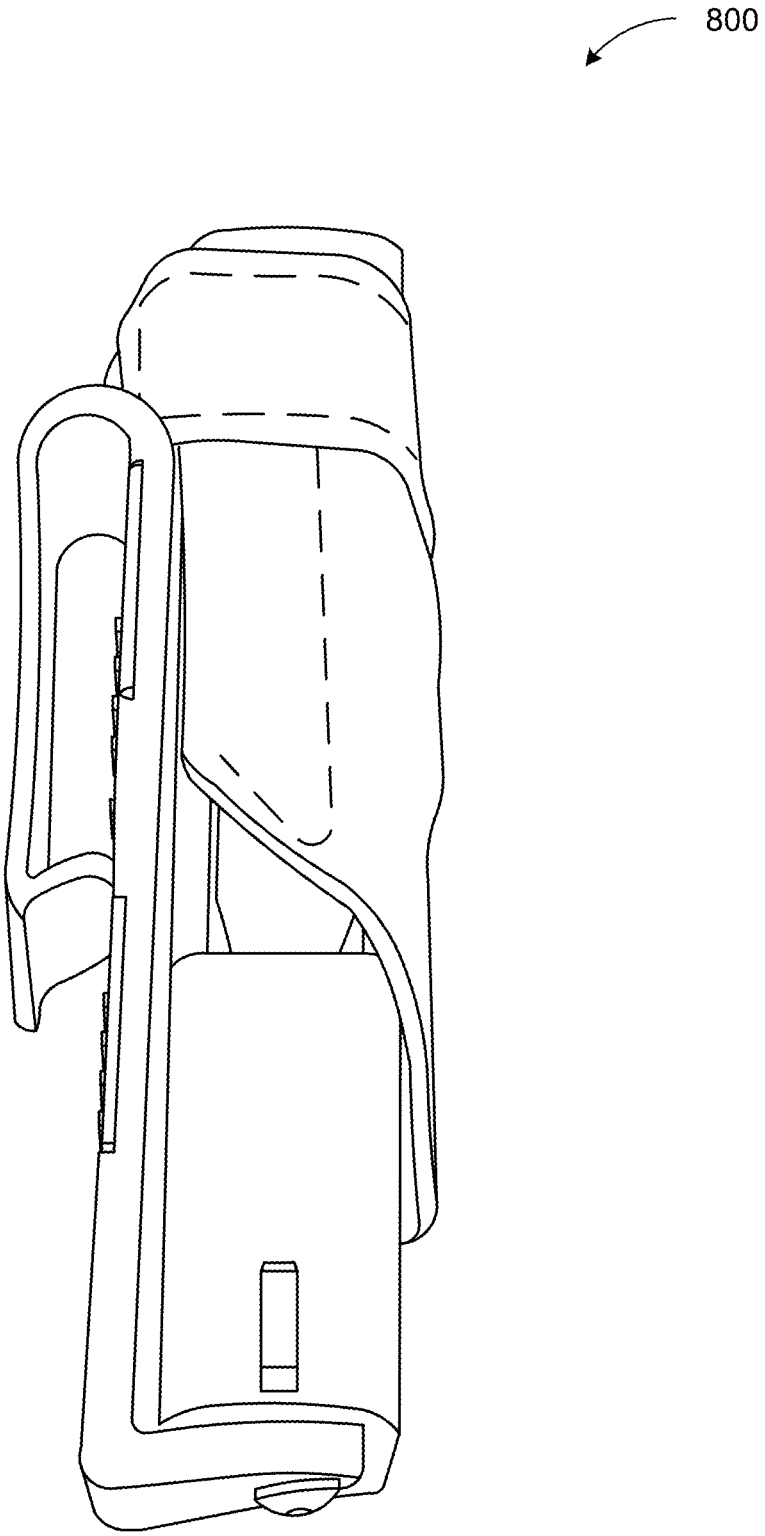
FIG. 8 shows a perspective view of one embodiment in which a firearm is fully seated on an insert member and covered with wrap member.

FIG. 8 shows a perspective view of one embodiment in which a firearm is fully seated on an insert member 18 and covered with a wrap member 102. In this photo member 102 is fully positioned over the firearm covering previously exposed areas seen in FIG. 7. Magnets embedded in member 102 are securely fastened to the top and side of the firearm. It should be known that the resting location of the magnets is not limited to the location shown, and any location can be used. An example of one variation can be seen in FIG. 25 2502. FIG. 8 also shows the firearm fully seated onto member 16 which is inserted into the firearm's barrel. It is to be known that the location of the magnets in the photos are merely one of many possible configurations and locations. The device is not limited in any way to a certain number, style, shape, size, and pull force of the magnets shown.

Figure 9:
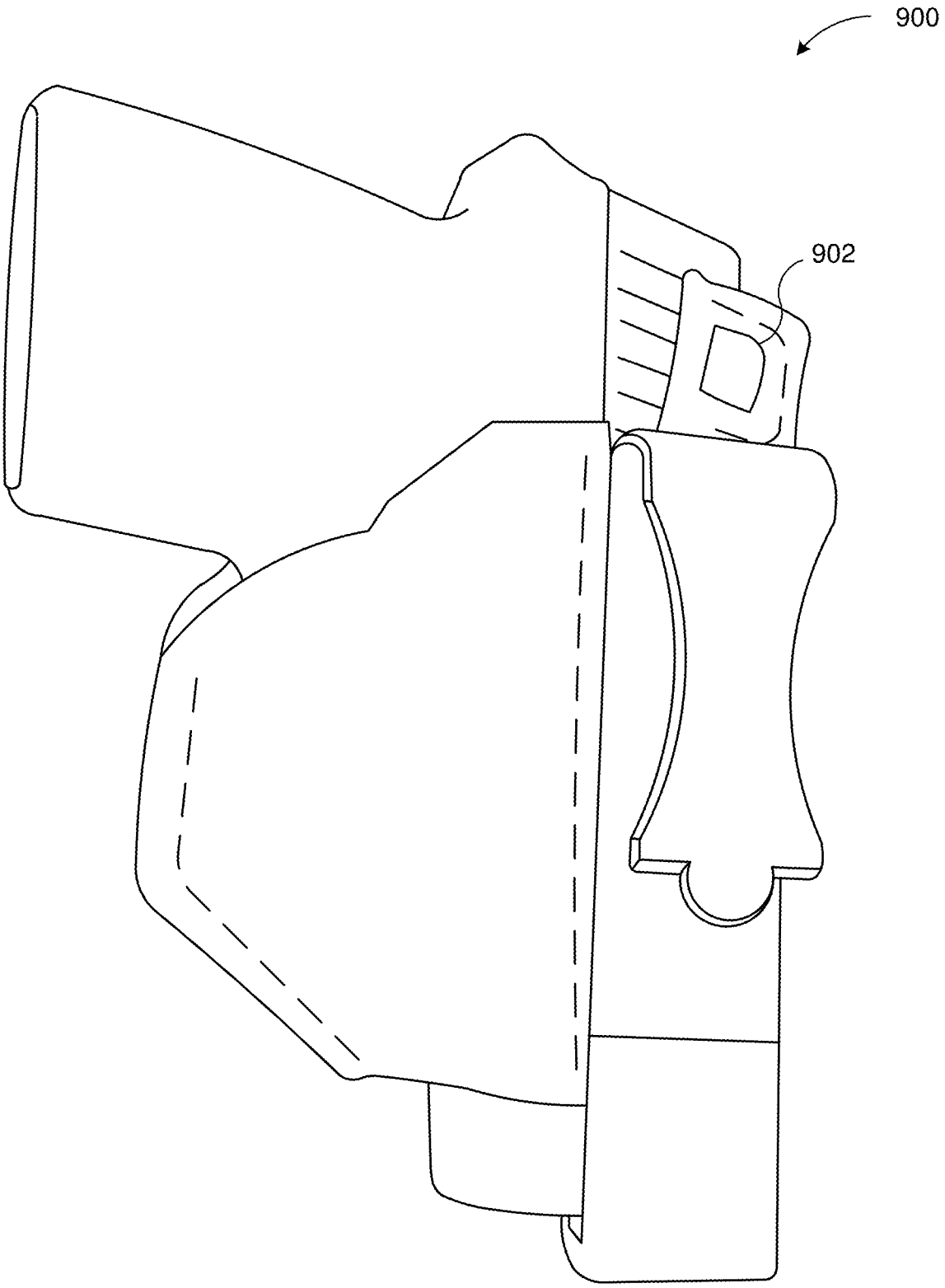
FIG. 9 illustrates a perspective view of one embodiment of the back side of the arrangement shown in FIG. 8.

FIG. 9 illustrates a perspective view of one embodiment of the back side of the arrangement shown in FIG. 8. Member 902902 is an extension of member 102 and in this embodiment, it has been constructed of a separate material sewn to member 102. It easily could be made as one piece from the same material as 102. It could also be made of different material, such as nylon, cotton, leather, plastic, elastic, and any other material suitable for construction. For example, FIG. 27 2702 shows a member 102 with multiple materials used. Member 902 also has a magnet sewn into it for securing to the firearm. This member 902 could be constructed in a way to fully secure the firearm requiring its removal prior to drawing the firearm, or in this configuration providing retention which is overcome by the force of the user's drawn releasing the firearm. It is to be noted that during removal of the firearm members 102 & 902 will release when enough force is applied during the drawing process. The ability to release the firearm without having to manipulate a strap or lever can be beneficial in high stress situations. It should be noted this device is not limited to not having a secondary strap or lever that involves manipulation prior to removing the firearm. The example shown is just one of many possible configurations. For example, FIG. 34 3402 shows a version of member 102 with a secondary strap that involves manipulation prior to removing the firearm.

Figure 10:
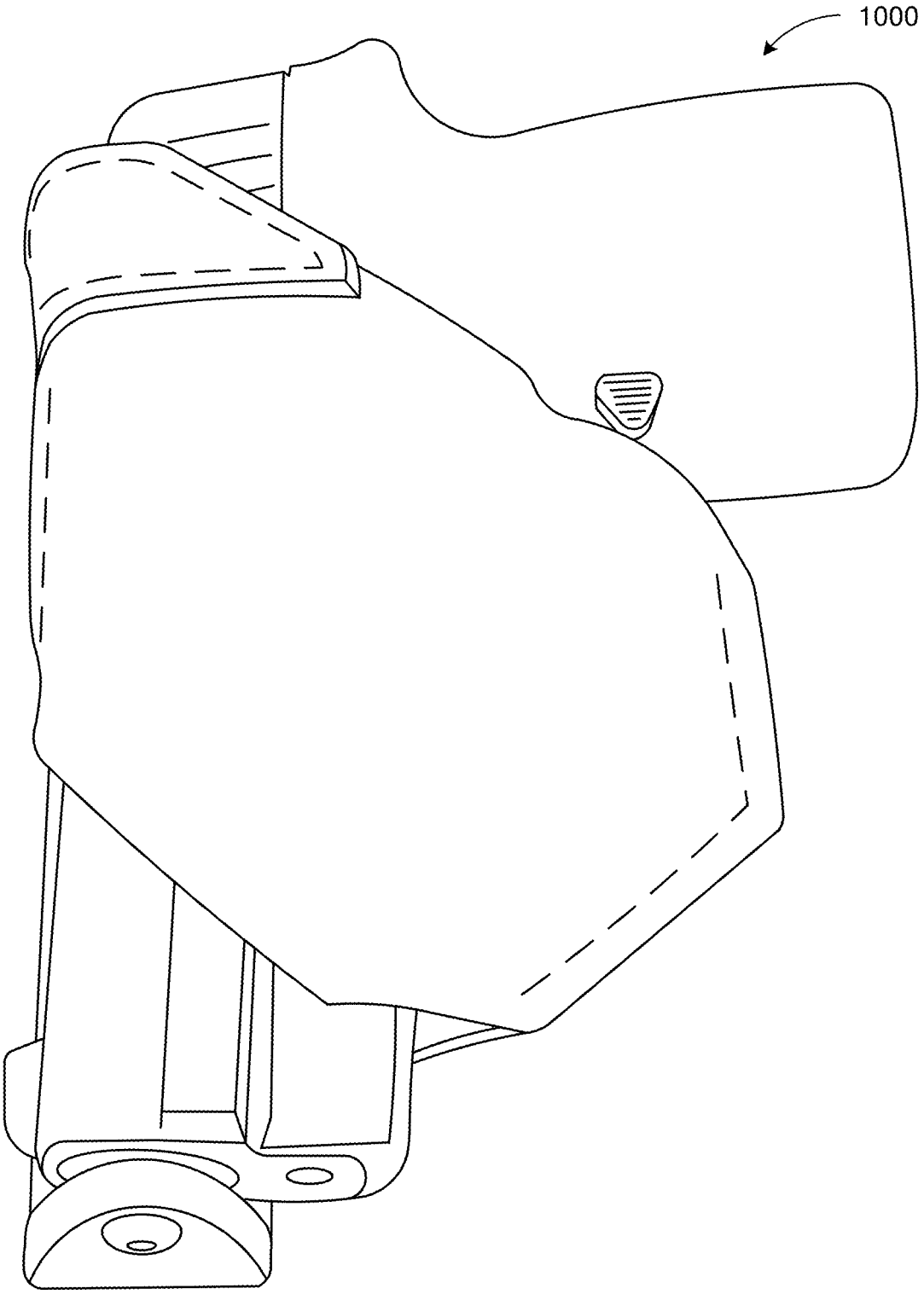
FIG. 10 depicts one embodiment of a front side view in which a firearm is fully seated on an insert member and covered with wrap member.

FIG. 10 depicts one embodiment of a front side view in which a firearm is fully seated on an insert member and covered with a wrap member.

Figure 11:
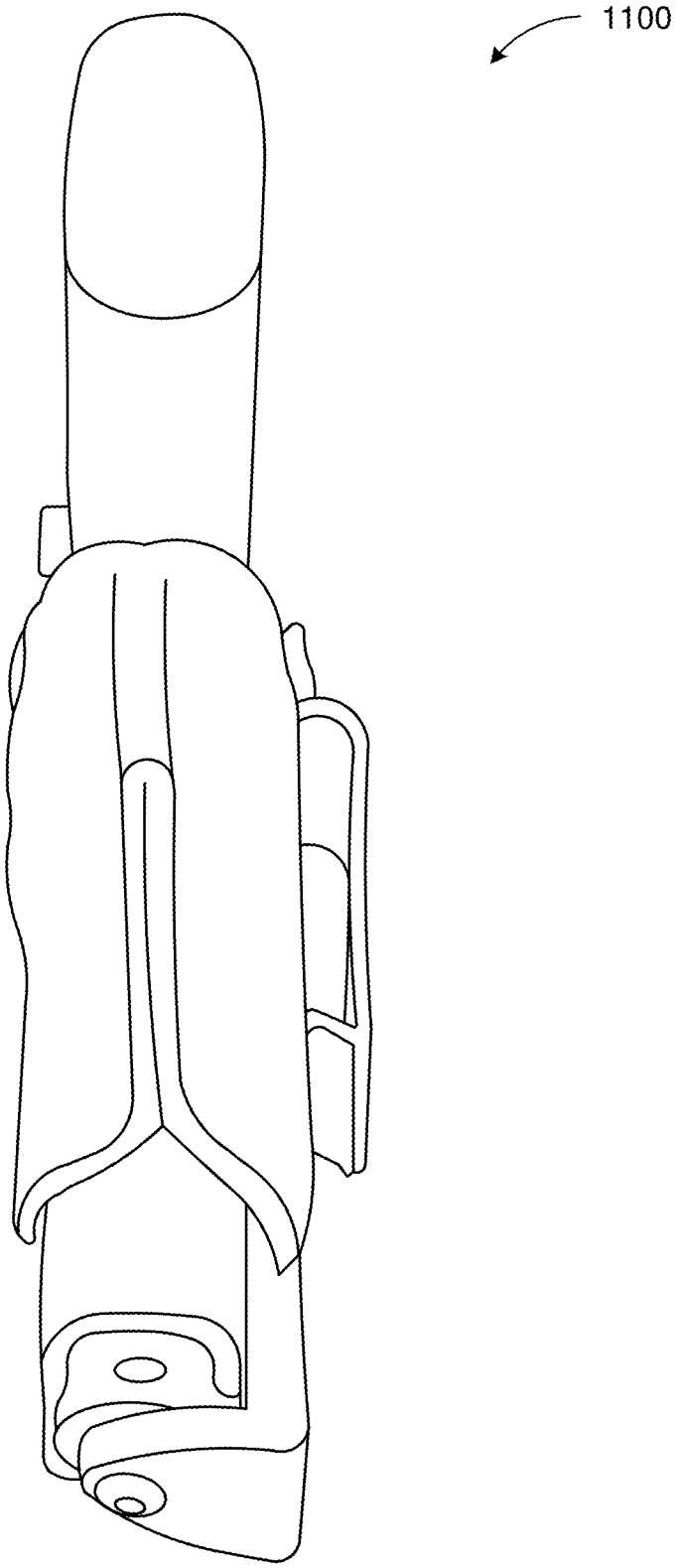
FIG. 11 shows one embodiment of an alternative side view of the arrangement shown in FIG. 10.

FIG. 11 shows one embodiment of an alternative side view of the arrangement shown in FIG. 10.

Figure 12:
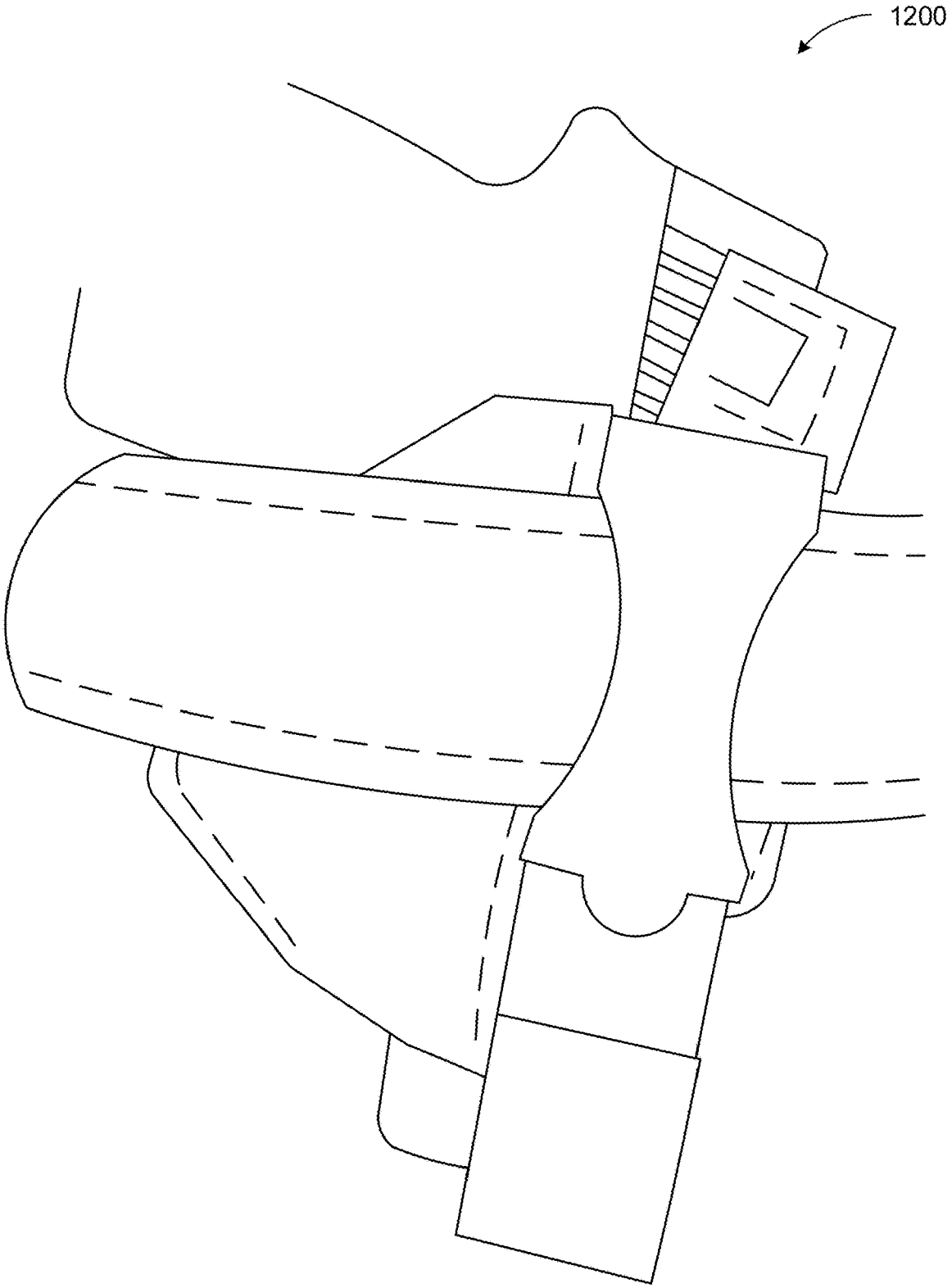
FIG. 12 depicts one embodiment of a perspective view of a secured firearm component carried on a user's waistline.

FIG. 12 depicts one embodiment of a perspective view of a secured firearm component carried on a user's waistline. It should be noted that this figure shows the device and firearm positioned between the user's belt and pant material. This is but one configuration of many for carrying a firearm with the disclosed device, for example it could also be carried completely inside the user's waistline with just the member 14 attached to the user's belt. this device could be built with member 14 in multiple options of carry angle allowing the firearm to sit at any angle on the user's waistline.

Figure 13:
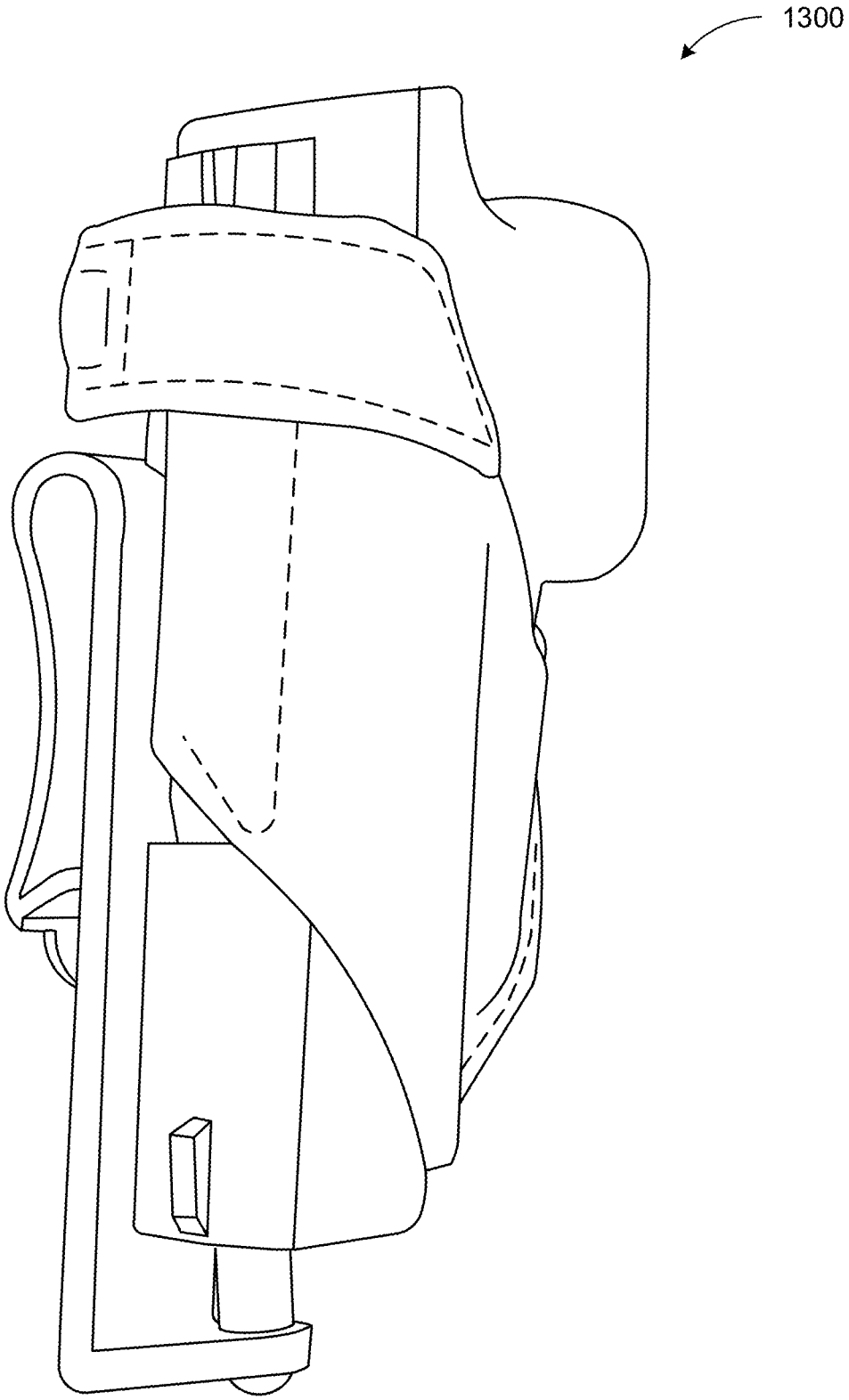
FIG. 13 shows one embodiment of the wrap member released from the firearm.

FIG. 13 shows one embodiment of the wrap member released from the firearm. Wrap member 102 and its embedded magnets slide along the firearm as it is moved away from the main body assembly 12. During this motion member 102 is free to flex away, towards, in line with, or any direction as the firearm is being drawn. This greatly reduces draw friction when the firearm is intended to be removed. In this drawing motion a unique benefit of this device is witnessed, whereas traditional holsters have the same amount of friction when carrying a firearm as they do when drawing a firearm. It is advantageous for a user to have ample amount of retention when carrying a firearm, but reduced retention when drawing a firearm. The ability of the disclosed device to flex away, towards, in line with, or any direction as the firearm is being drawn, serves the purpose of reducing draw tension for the end user, and this results in a smoother and quicker draw. It should be known that the disclosed device is no limited to the method in which member 102 applies and reduces friction to the firearm being carried. For example, as opposed to the magnets in member 102 moving away from the firearm, they could remain attached as the firearm is pulled across the magnets. Another example could have member 102 attached at two locations on the main body 12 creating a fully connected member 102 that cannot move away from the main body 12. An example can be seen in FIG. 42 (4202, 4204).

Figure 14:
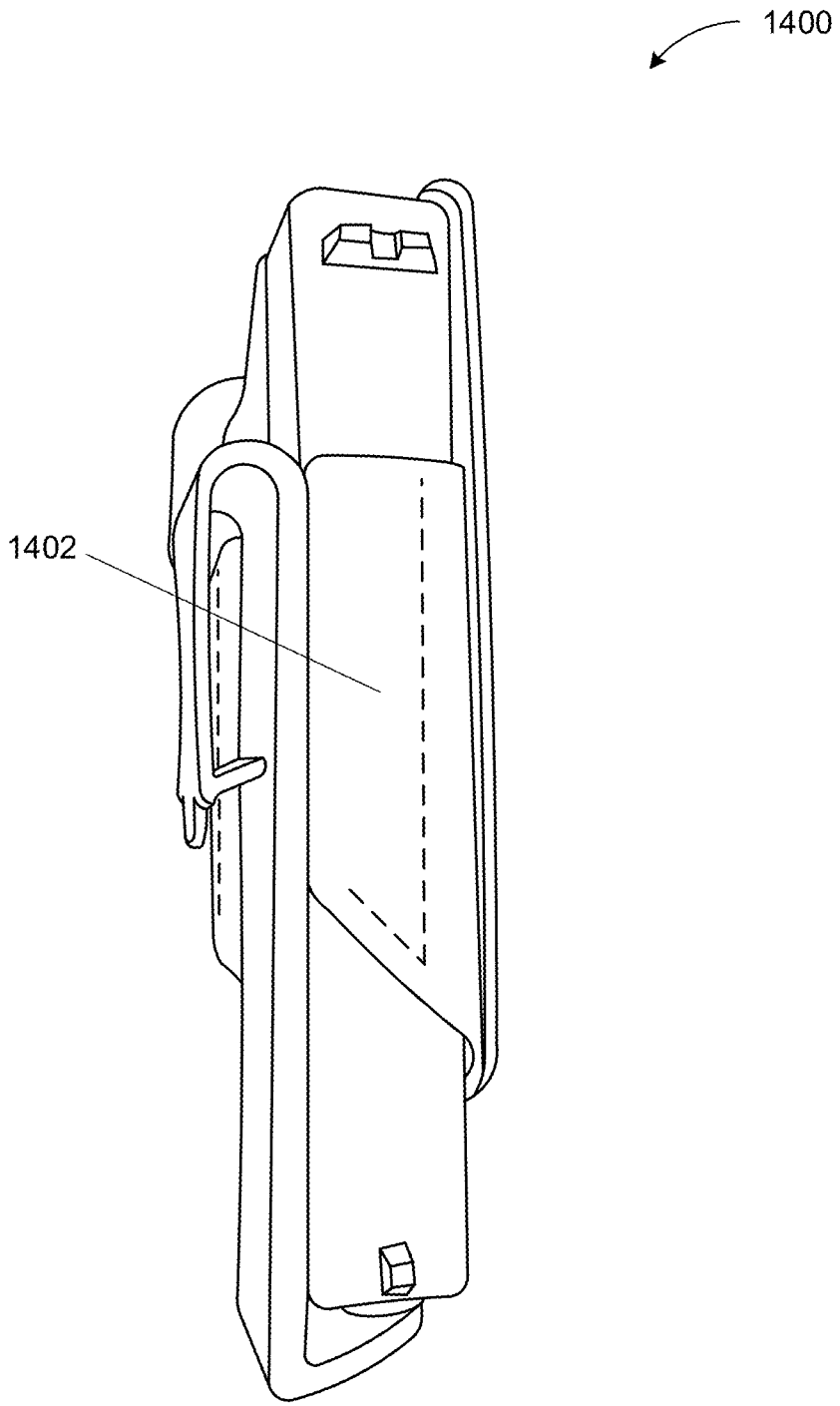
FIG. 14 shows another embodiment in which the wrap member is form-fitted.

FIG. 14 shows another embodiment in which the wrap member 102 is form-fitted. In some embodiments, the wrap member 102 is adapted to a particular firearm. In this variation member 102 is constructed of leather, and held securely in place with magnets sewn into a pocket 104 notated as 1402 in FIG. 14. It should be noted this device is not limited to using leather for member 102 or any component used, furthermore it would be possible to construct any component of this device through molding, 3D printing, Ultrasonic Welding, and any other known method. Member 102 could also be connected permanently to the opposing side of the main body 12 as opposed to using magnets or any other holding device. An example can be seen in FIG. 49.

Figure 15:
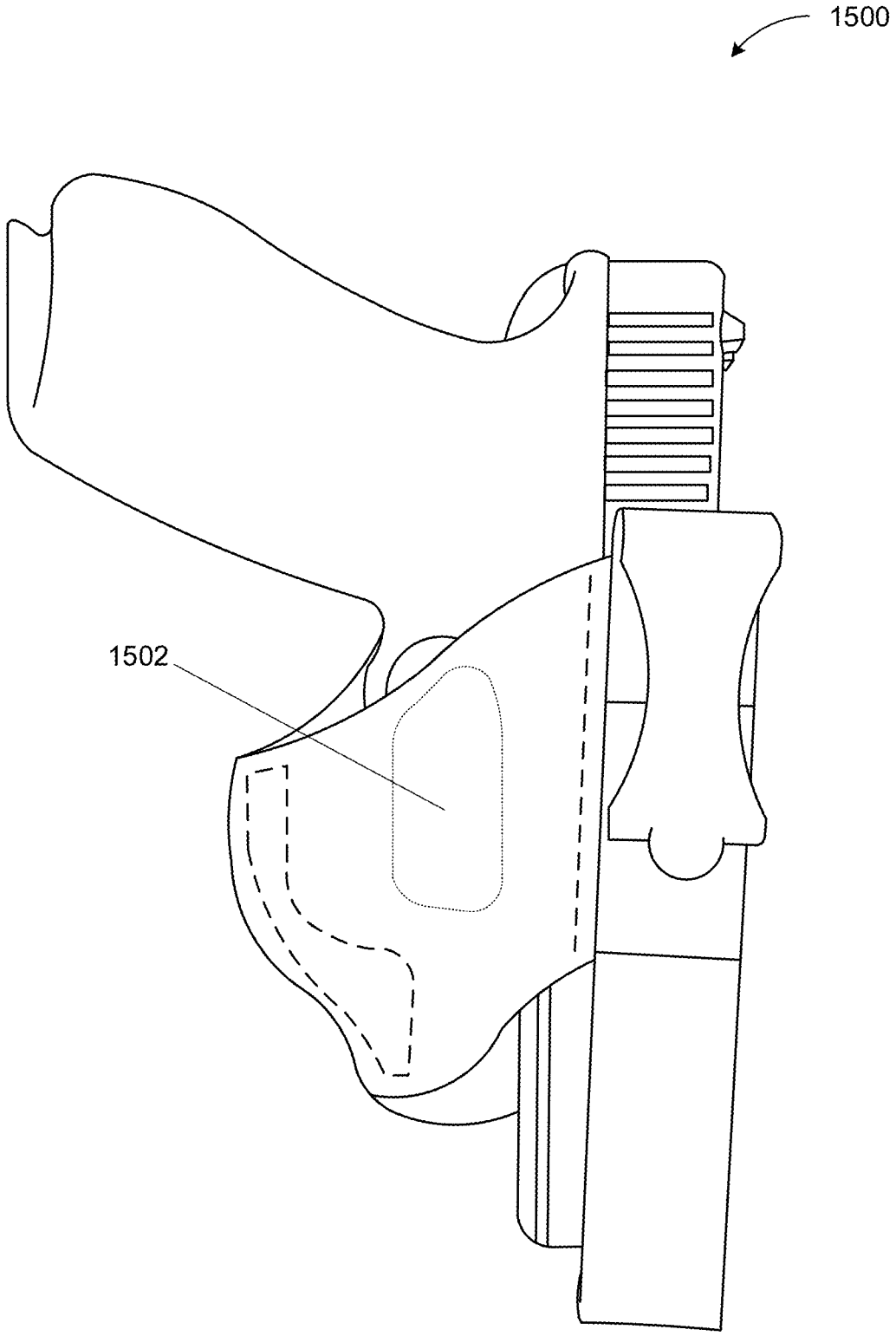
FIG. 15 illustrates one embodiment of a back side view of a wrap member that is form-fitted.

FIG. 15 illustrates one embodiment of a back side view of a wrap member 102 that is form-fitted. 1502 shows an impression molded into member 102 to create retention around the firearm's trigger guard. The shape used for member 102 in FIG. 15 is but one of many shapes and designs that could be used.

Figure 16:
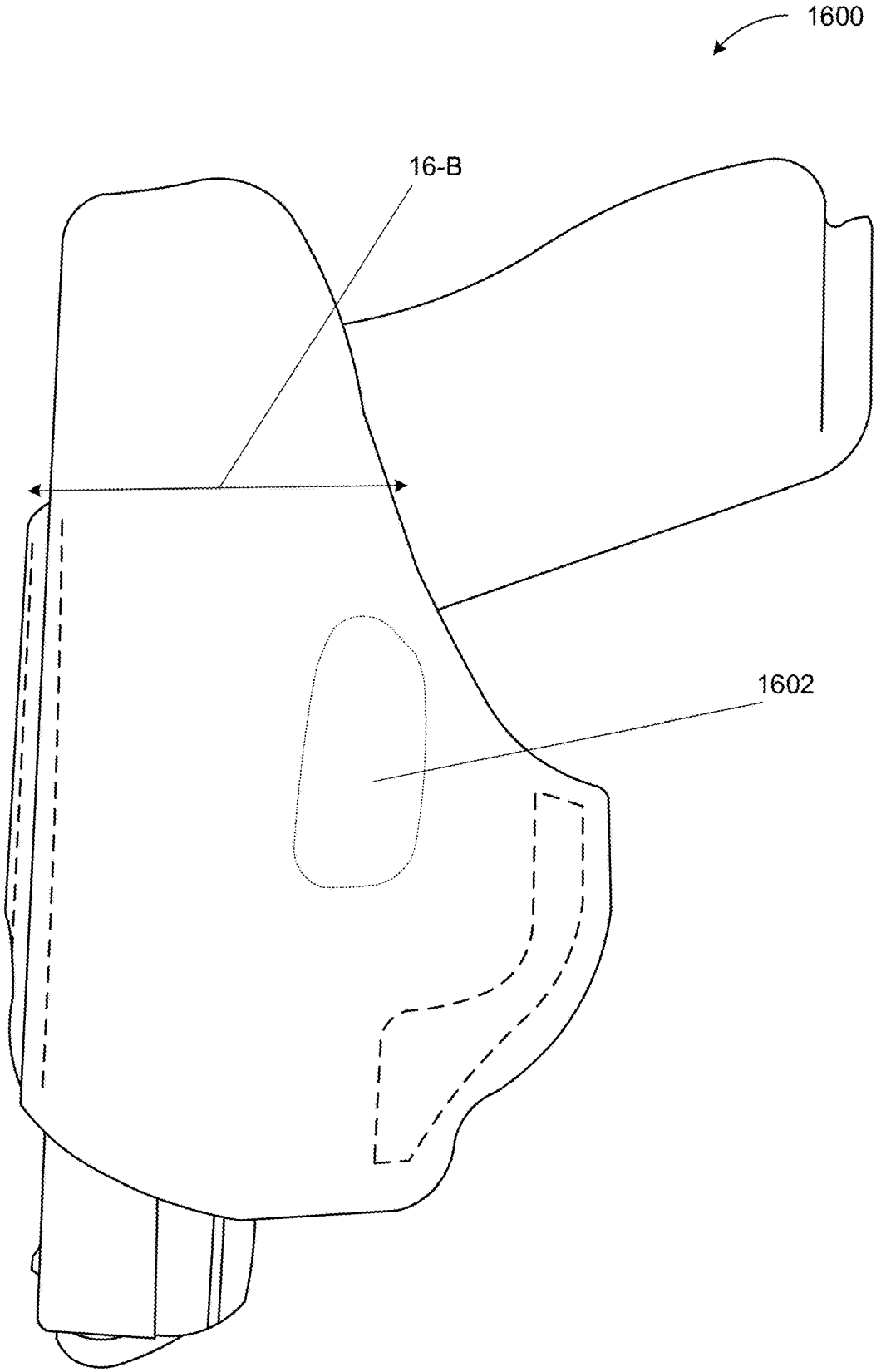
FIG. 16 illustrates one embodiment of a front side view of the form-fitted wrap member.

FIG. 16 illustrates one embodiment of a front side view of the form-fitted wrap member 102. Feature 1602 is referencing a molded indention on the reverse side of member 102. The shape used for member 102 on this side of the firearm is elongated to cover sharp edges and corners of the firearms slide. This design is not limited to this shape and could be reduced or increased in size. For example, the portion notated by 1602 could be removed.

Figure 17:
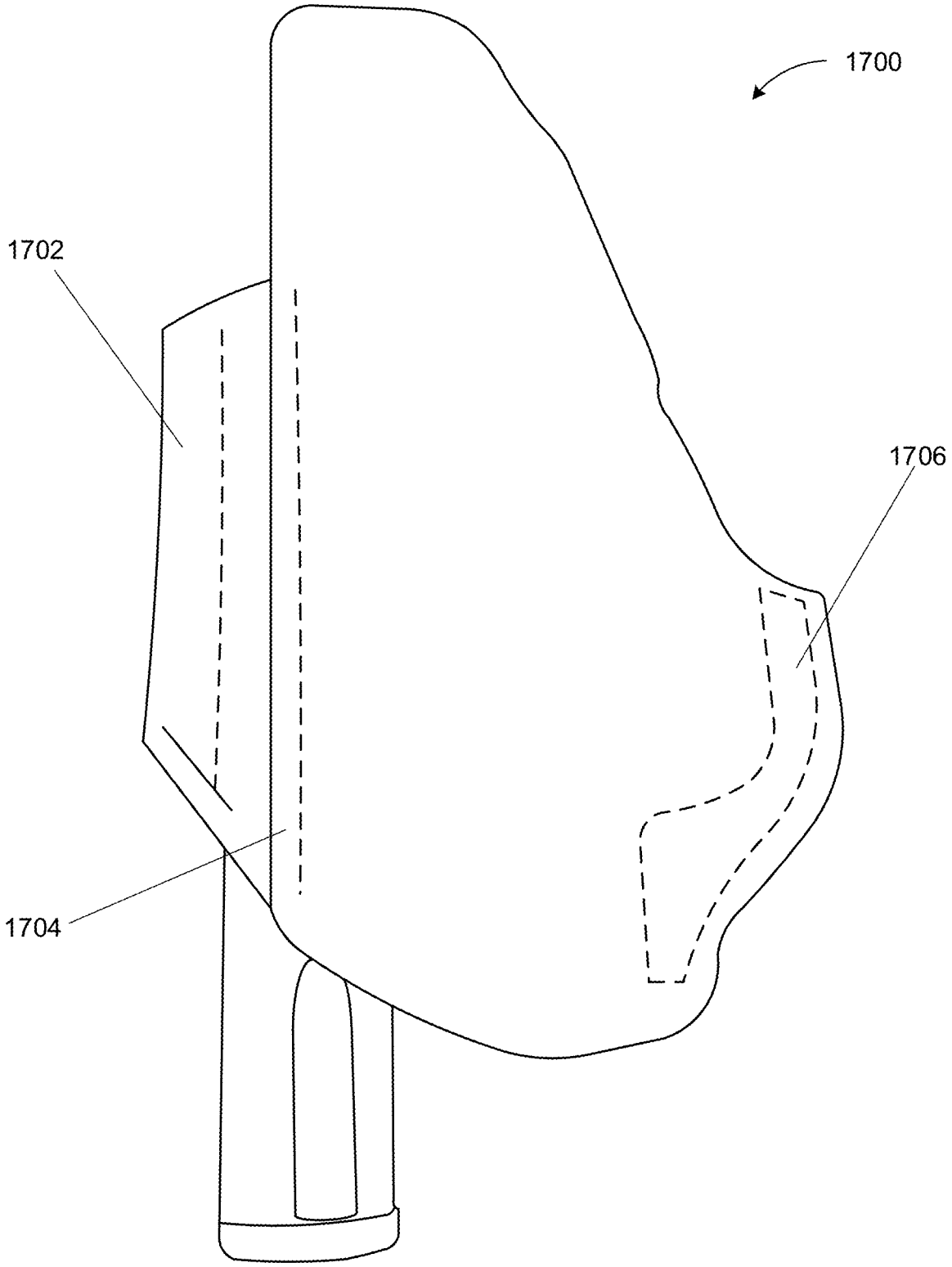
FIG. 17 depicts one embodiment of a form-fitted wrap member with main body assembly without a firearm installed.

102 FIG. 17 depicts one embodiment of a form-fitted wrap member 102 with main body assembly 12 without a firearm installed. 104 notated 1702 on FIG. 17, shows a pocket formed for holding magnets, however, it should be noted that the pocket does not have to be in this configuration style or location. Example, in FIG. 25, magnets are embedded in an alternative location creating pull against the side of the firearms as opposed to the top of the firearm. A secondary member has been joined to member 102 notated by joint 1704. This form fitted member 102 is not limited to having multiple components or materials, and could be created of one material as opposed to multiple. For example, the entire member 102 could be injection molded of plastic and the form fitting indentations could be molded into this variation. 1706 notates a joint where two pieces have been sewn together to form the portion of this form fitted member 102 that wraps around both sides for the firearm. A form fitted member 102 could be constructed without this joint, or with this joint made of an alternative material. An alternative construction could have joint 1706 constructed of a flexible plastic, rubber, neoprene, or many other materials.

Figure 18:
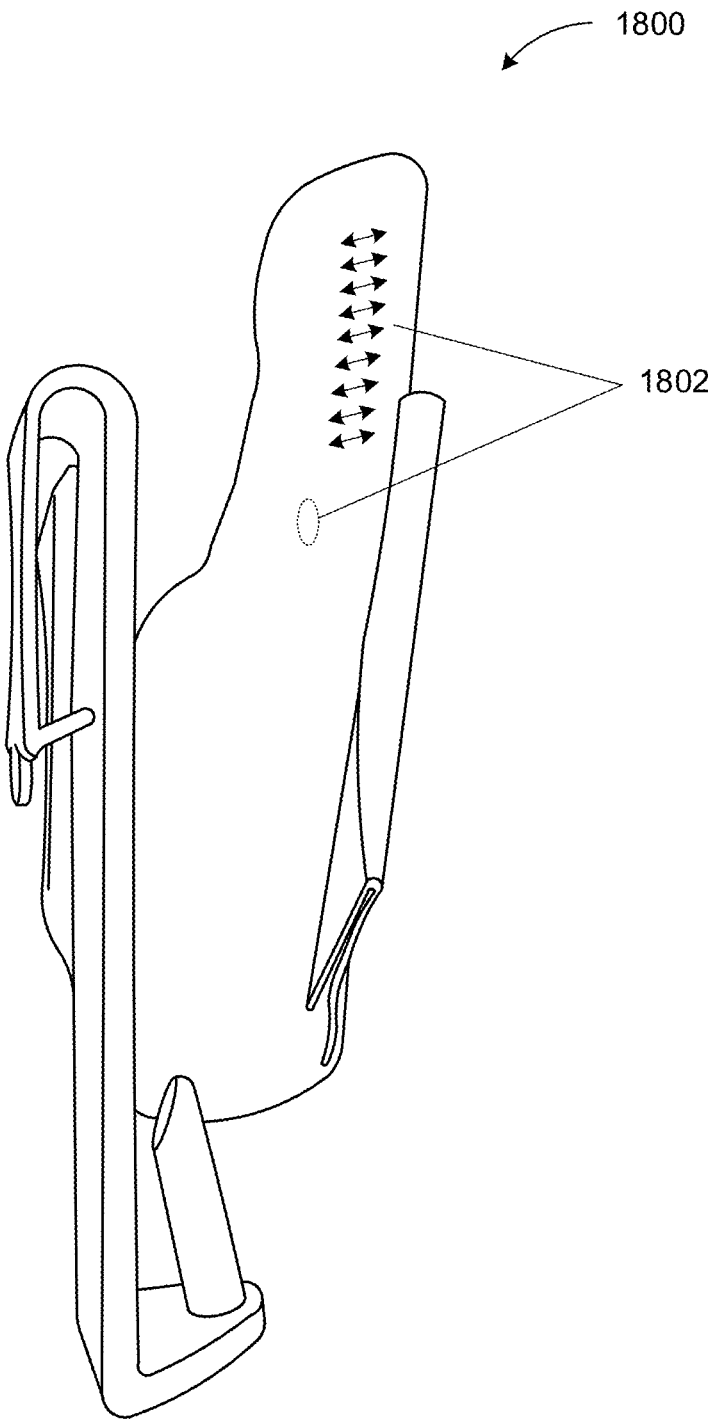
FIG. 18 shows one embodiment of an inside of a form-fitted wrap member.
Figure 19:
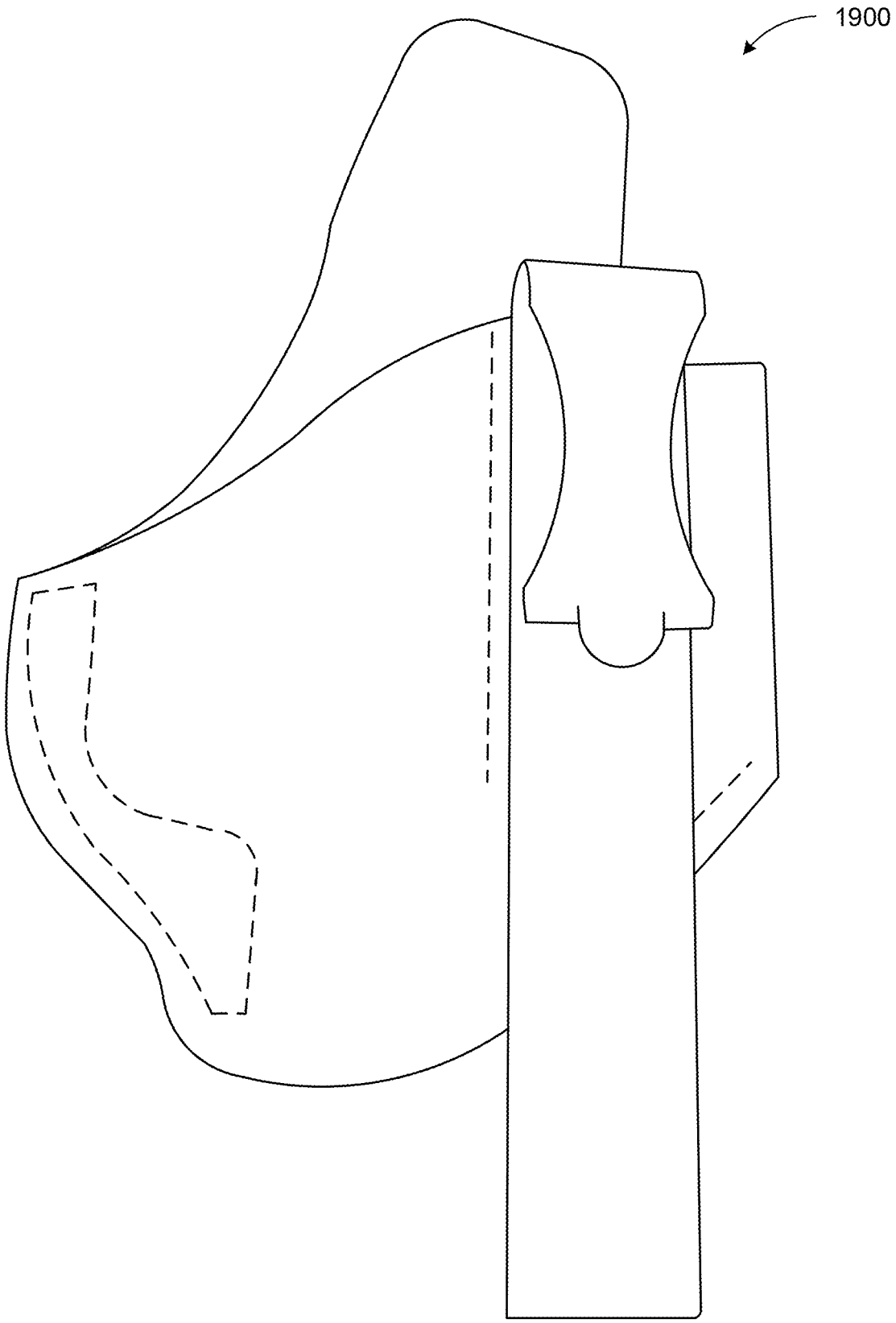
FIG. 19 shows illustrates one embodiment of a back side view of a form-fitted wrap member.
Figure 20:
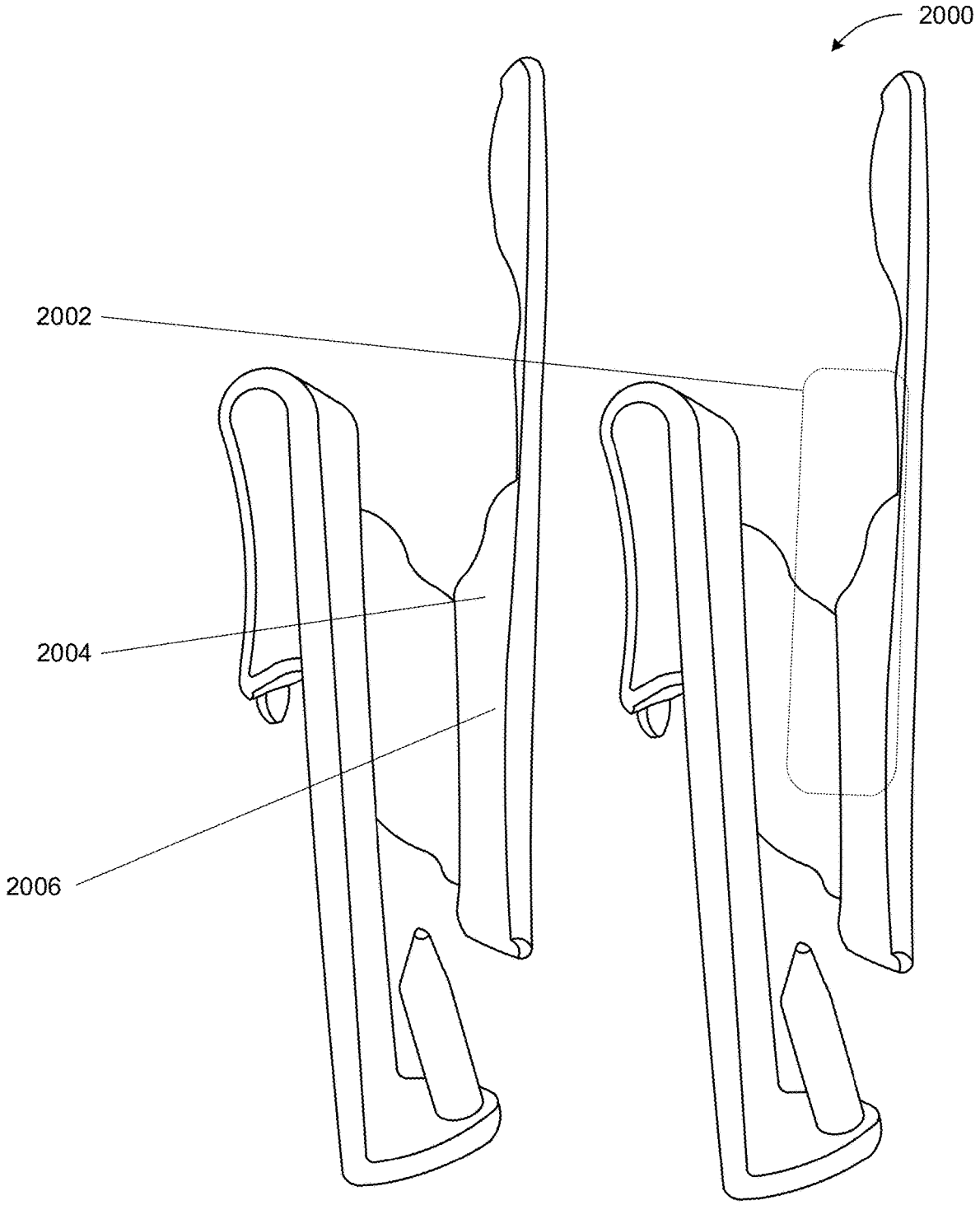
FIG. 20 shows one embodiment of a form-fitted wrap member.

FIG. 18 shows one embodiment of an inside of a form-fitted wrap member 102. Molded indentions to create a form fitted member 102 can be seen in 1802. These indentations serve to create friction against unwanted movement, and add visually appealing lines to member 102. FIG. 20 shows illustrates one embodiment of a back side view of a form-fitted wrap member 102.

FIG. 20 shows one embodiment of a form-fitted wrap member. This variation of a form-fitted member 102 does not have a location for magnets on top of the firearm as in FIG. 14 1402. 2002 shows where the magnets may be embedded, and 2004 shows the location devoid of magnets. It is to be noted that magnets may be in the side of member 102 notated by 2006, as they are in FIG. 29 2602.

FIG. 21 shows another embodiment of a wrap member 102 without the joint illustrated in FIG. 17 1706. This variation of member 102 is shown unfolded, which allows access to the main body 12. This variation is sewn with an elastic center notated by 2102, 2104) between two leather pieces intended to cover the firearm. The elastic center 2102, 2104 allows this variation of member 102 to increase and decrease in size. This variation of member 102 has magnets embedded in the area marked 2106 allowing member 102 to attach magnetically to exposed areas of the firearm. 2108 is a sewn piece of elastic to allow 2106 to be positioned in varying locations in which the user can alter as desired. This variation is not limited to elastic, and could be built of an entirely like material, or could be made of plastic, 3-D printing, rubber, cotton, nylon, and other materials. It should also be noted that this variation of member 102 could be built in a form fitted version for a particular firearm. An example of such would be a model form fitted to the Kahr brand firearms, and having key features of the Kahr brand firearms molded into the components.

Figure 22:
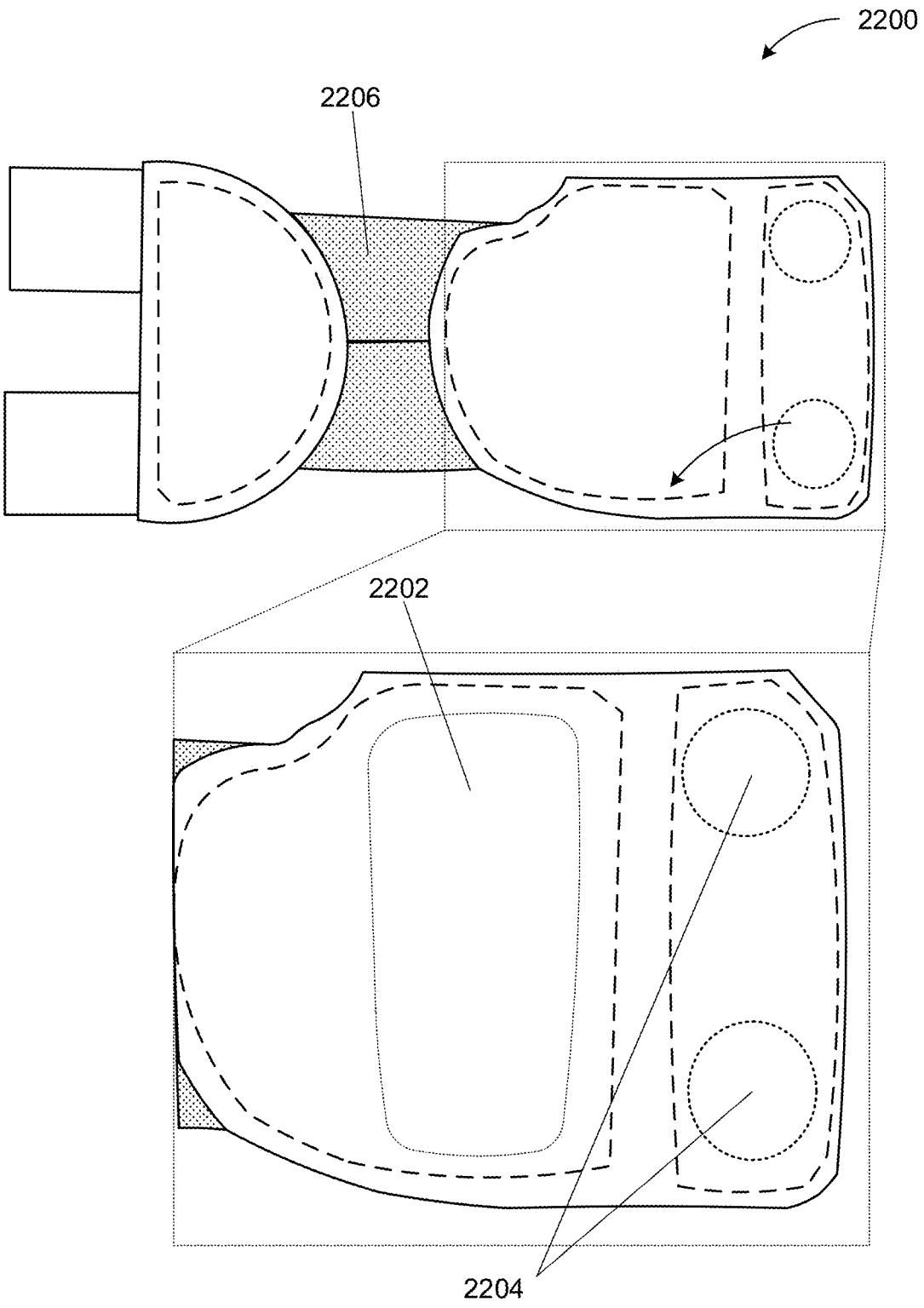
FIG. 22 depicts another embodiment of the wrap member.

FIG. 22 depicts another embodiment of the wrap member 102. This variation has padding added to member 102, notated by 2202. This padding can serve as a shield between the user and the firearm to add extra comfort when carrying a firearm. Padding can also serve as another source of retention as it forms around and in features on the firearm being carried. This alternative member 102 has magnets embedded in location 2204. It should be known that this variation of member 102 could be built without magnets, or with magnets in alternative locations. In this model elastic has been used to join two leather components together to form this variation of member 102, noted 2206. This model could be built without the use of elastic. For example, it could be constructed of all like material such as leather, and in one continuous piece. Another example, would be of a construction made completely of plastic, or rubber.

Figure 23:
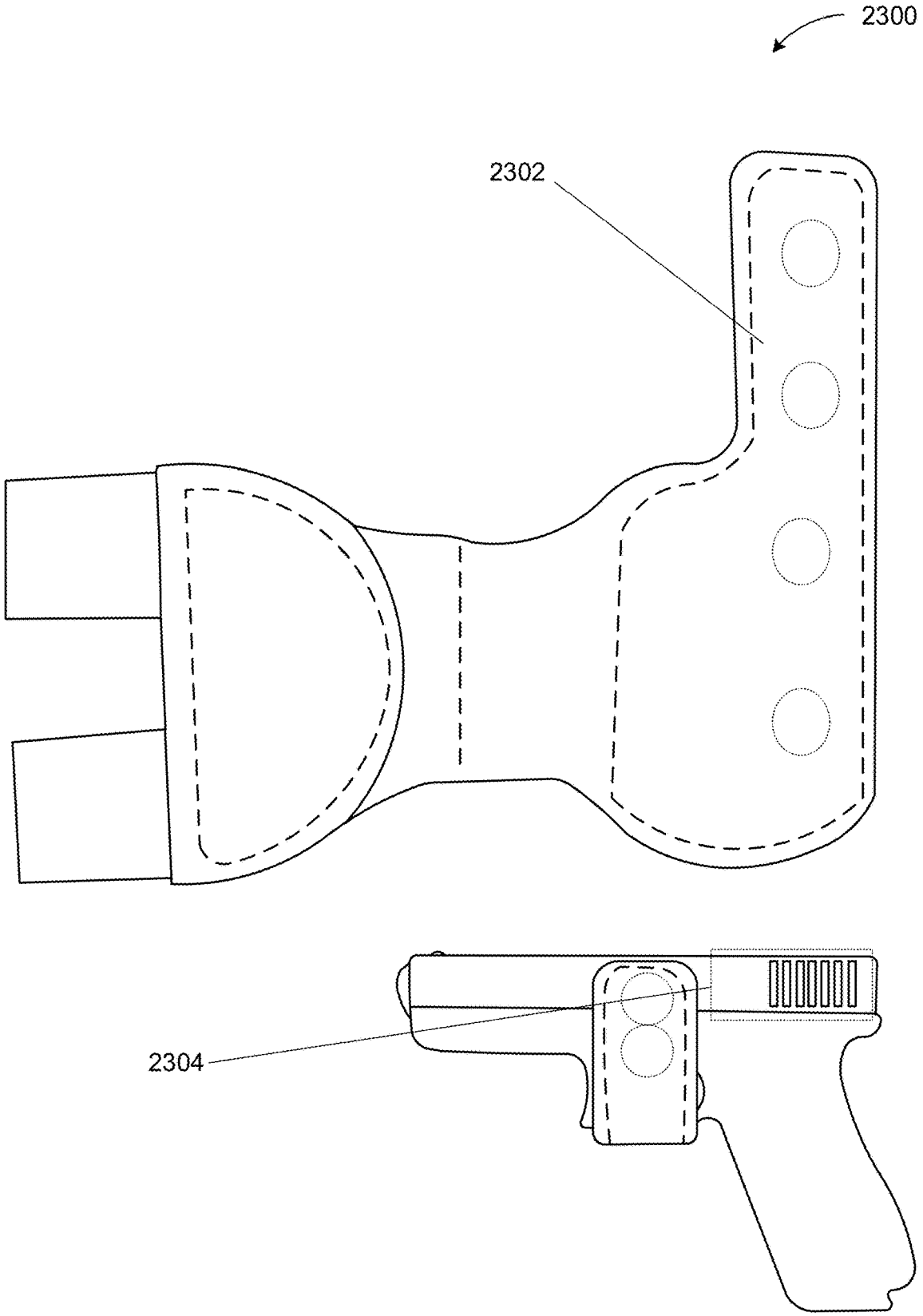
FIG. 23 illustrates another embodiment of a wrap member constructed with an elongated portion and magnets embedded within the elongated area.

FIG. 23 illustrates another embodiment of a wrap member 102 constructed with an elongated portion 2302 and magnets embedded within the elongated area. This elongated portion would come to rest on the side of a firearm and keep member 102 from unwanted movement. One potential location for such a design to come to rest is noted in FIG. 2304. It should be known that this design is not limited to an elongated portion, using magnets, or coming to rest in the location shown. For example, the elongated portion could be increased and cover the full length of the firearm from the muzzle to rear of slide.

Figure 24:
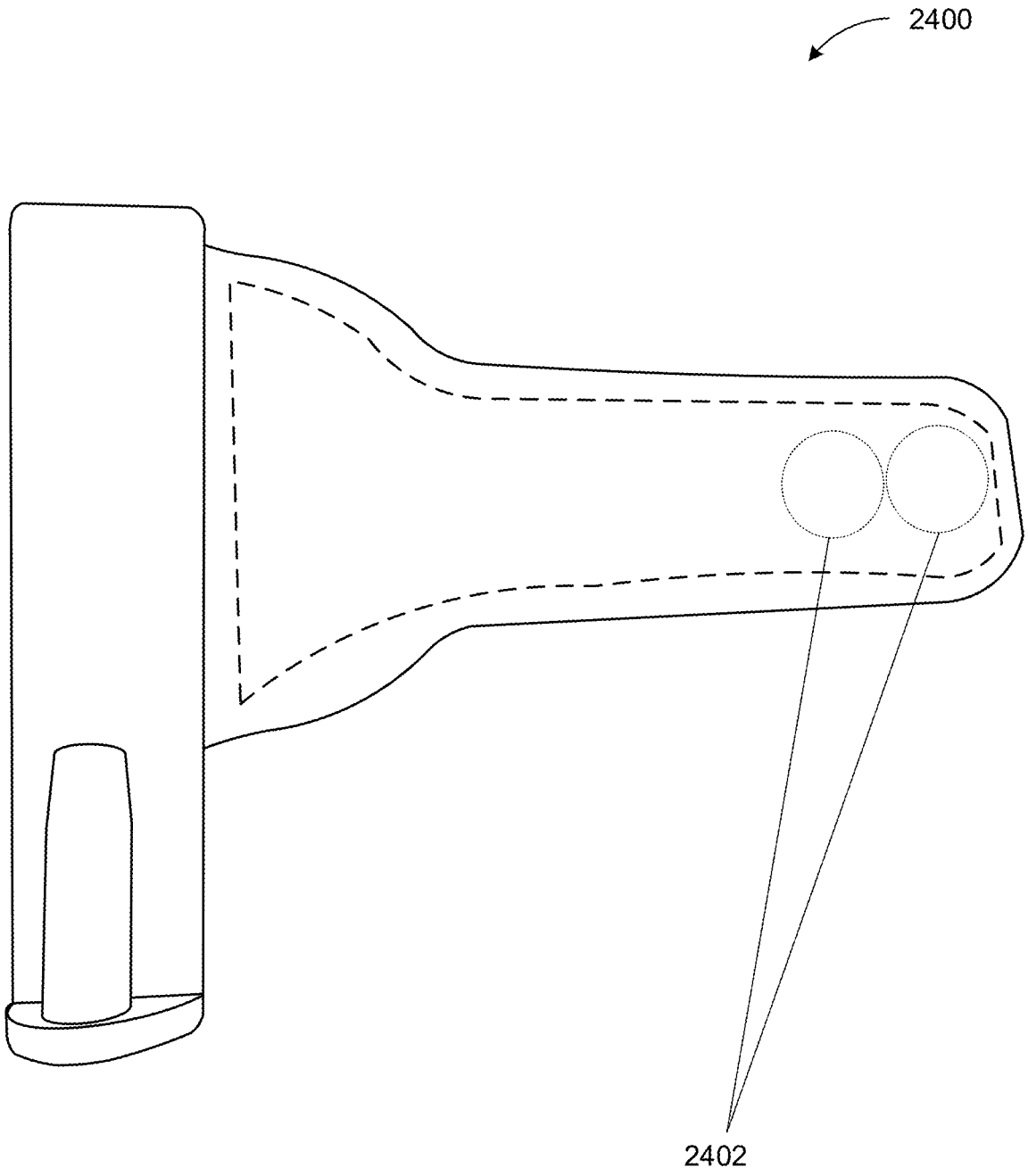
FIG. 24 shows another embodiment of a wrap member jointed to the main body assembly.

FIG. 24 shows another embodiment of a wrap member 102 jointed to the main body assembly 12. This variation is made of one strap that can form a u-shape around the firearm's trigger guard when attached to a firearm. In this variation member 102 has magnets embedded 2402 which can keep member 102 securely in place. this device is not limited to a one-piece construction, and could be made of multiple pieces sewn, adhered, molded, or sonic welded together.

Figure 25:
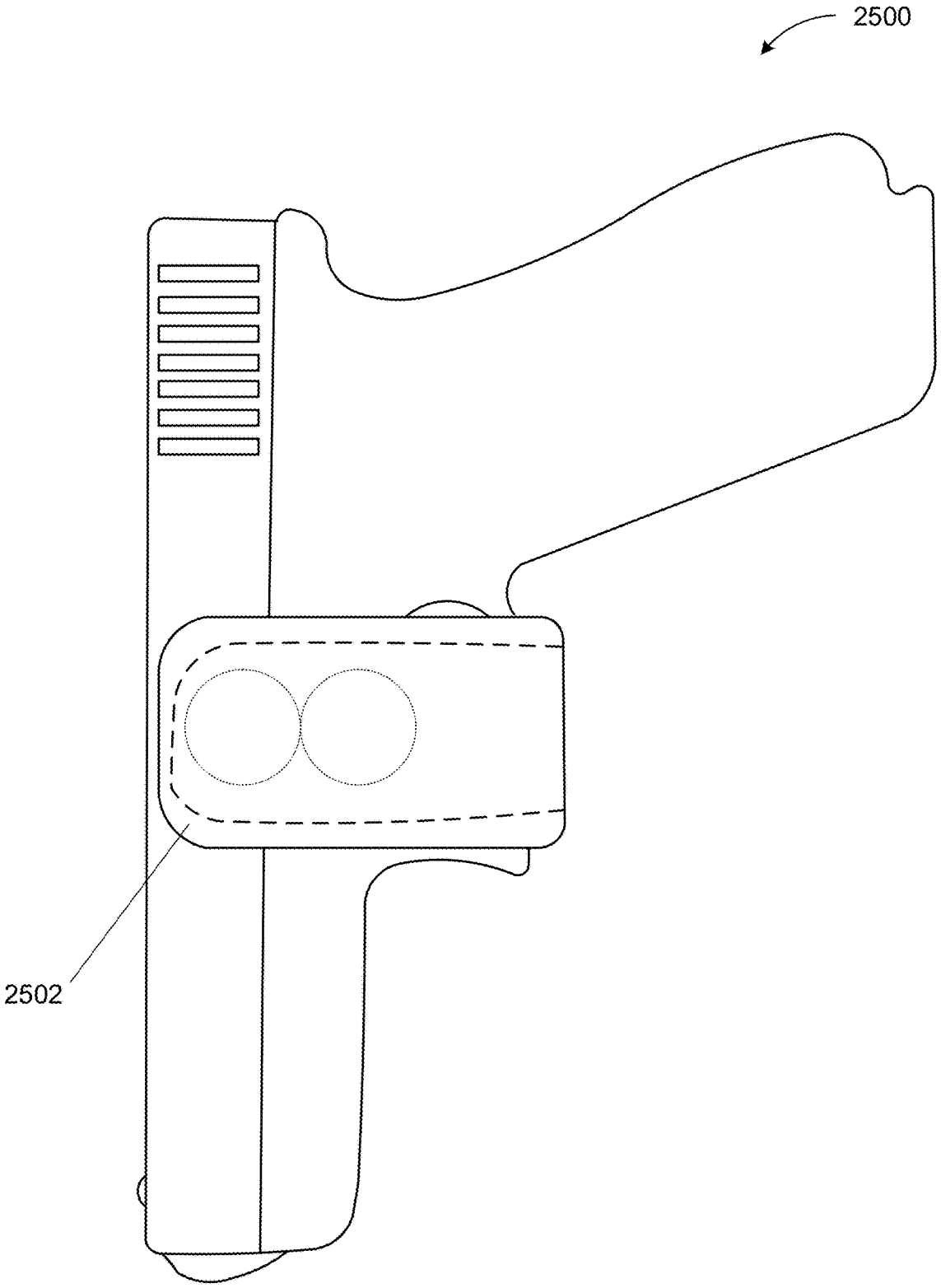
FIG. 25 depicts one embodiment with the systems of FIG. 24 attached to a firearm.
Figure 26:
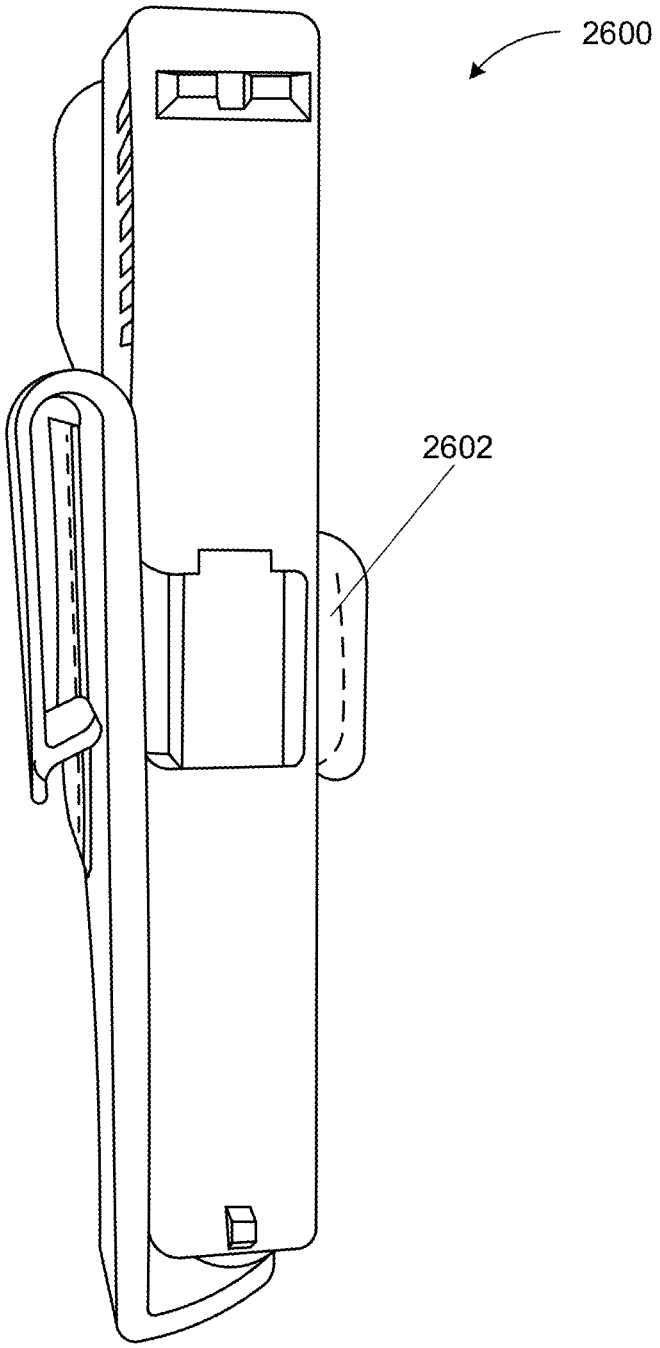
FIG. 26 depicts another embodiment of a side view of the system of FIG. 25.

102 FIG. 25 depicts one embodiment with the systems of FIG. 25 and FIG. 26 attached to a firearm. this device has magnets which are shown resting against the firearm 2502. These magnets hold this alternative version of member 102 in place against unwanted movement, and help stabilize the firearm against unwanted movement.

FIG. 26 depicts another embodiment of a side view of the system of FIG. 27. This angled view shows the top of the firearm, and the location the magnets are coming to rest against the firearm 2602.

FIG. 27 shows one embodiment of a wrap member 102 that can be folded across multiple axis to make attaching it to a firearm easier. This version uses leather components 2708, 2710, 2712, joined with nylon webbing at locations 2702, 2704. Components 2708, 2710, 2712 are constructed with padding for added comfort when carrying a firearm, and to create added point of retention. Added points of retention are formed as the padding conforms to the firearm. This version is not limited to using leather components, and or nylon. It could be constructed of one solid piece of material such as leather, plastic, nylon, rubber, or 3-D printed material. In this design magnets are located at three locations noted by 2706, this design isn't limited to three magnets, and could function with more or less magnets added. Furthermore, this design could be constructed with the absence of any magnets used. In this version member 102 is able to fold into a compact shape, 2712 would fold onto 2710, and then both 2712, 2710) would fold onto 2708. It is to be known that the number of components is not limited to three, and folds are not limited to two. For example, an alternative design could have four components and three folds, or two components and one fold.

Figure 28:
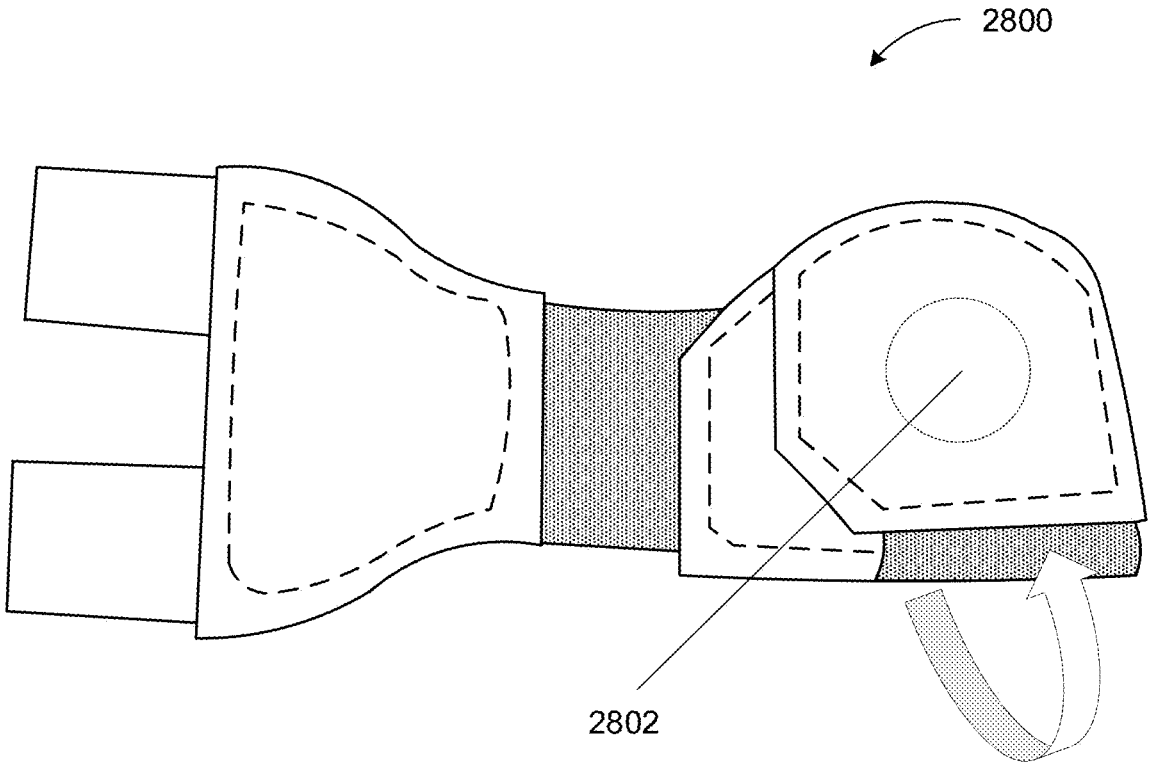
FIG. 28 illustrates one embodiment of a first fold arrangement.

FIG. 28 illustrates one embodiment of a first fold arrangement of component 2712 onto component 2710. Magnets in each component 2712 and 2710 attach together magnetically shown in 2802.

Figure 29:
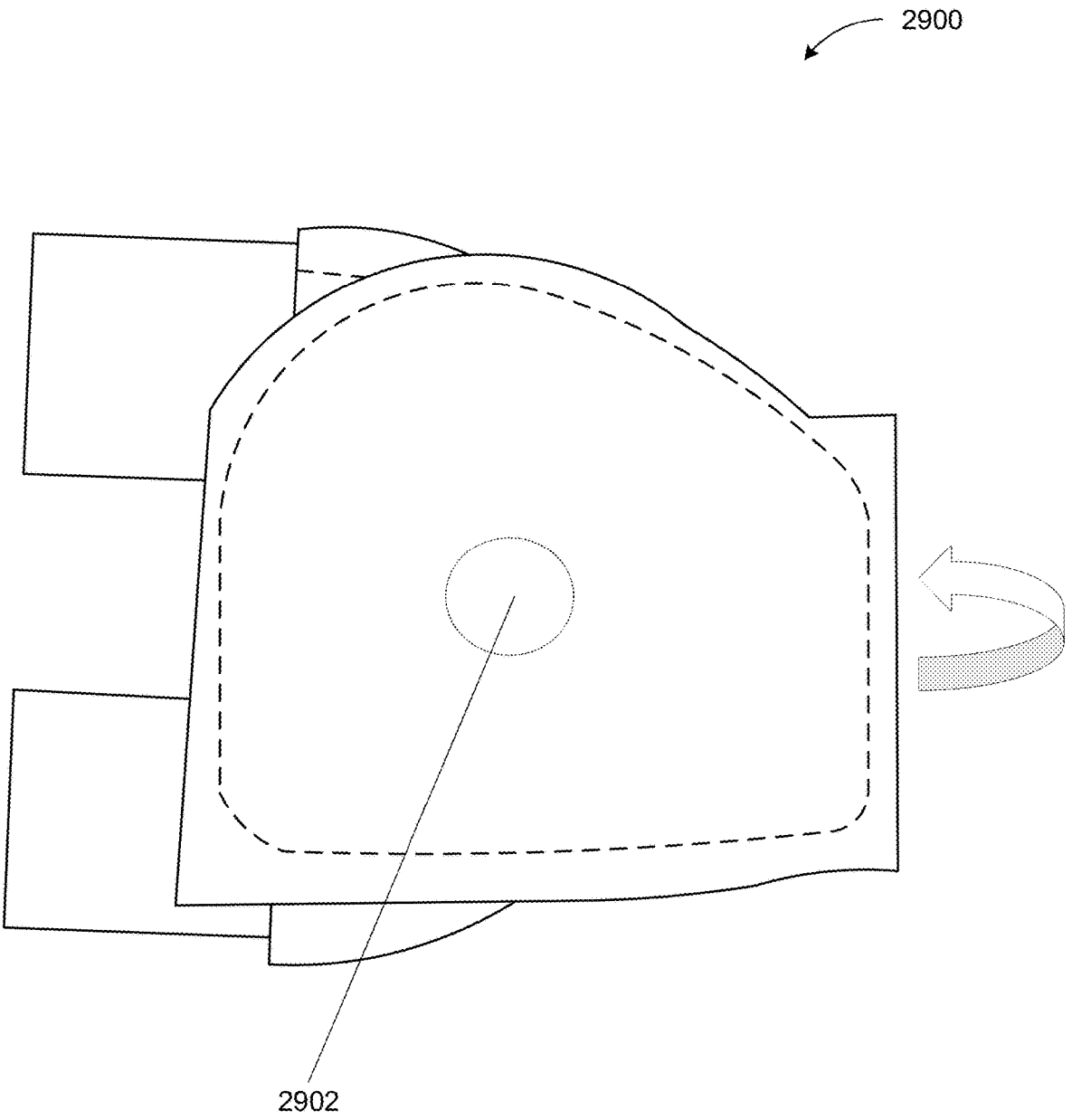
FIG. 29 shows one embodiment of a perspective view of a final fold arrangement.

FIG. 29 shows one embodiment of a perspective view of a final fold of components 2712, 2710 onto component 2708. Magnets in all three components hold the group together notated 2902. Magnets are not the only means for holding the components together, alternative methods such as hook and loop, adhesives, and other methods could be used.

Figure 30:
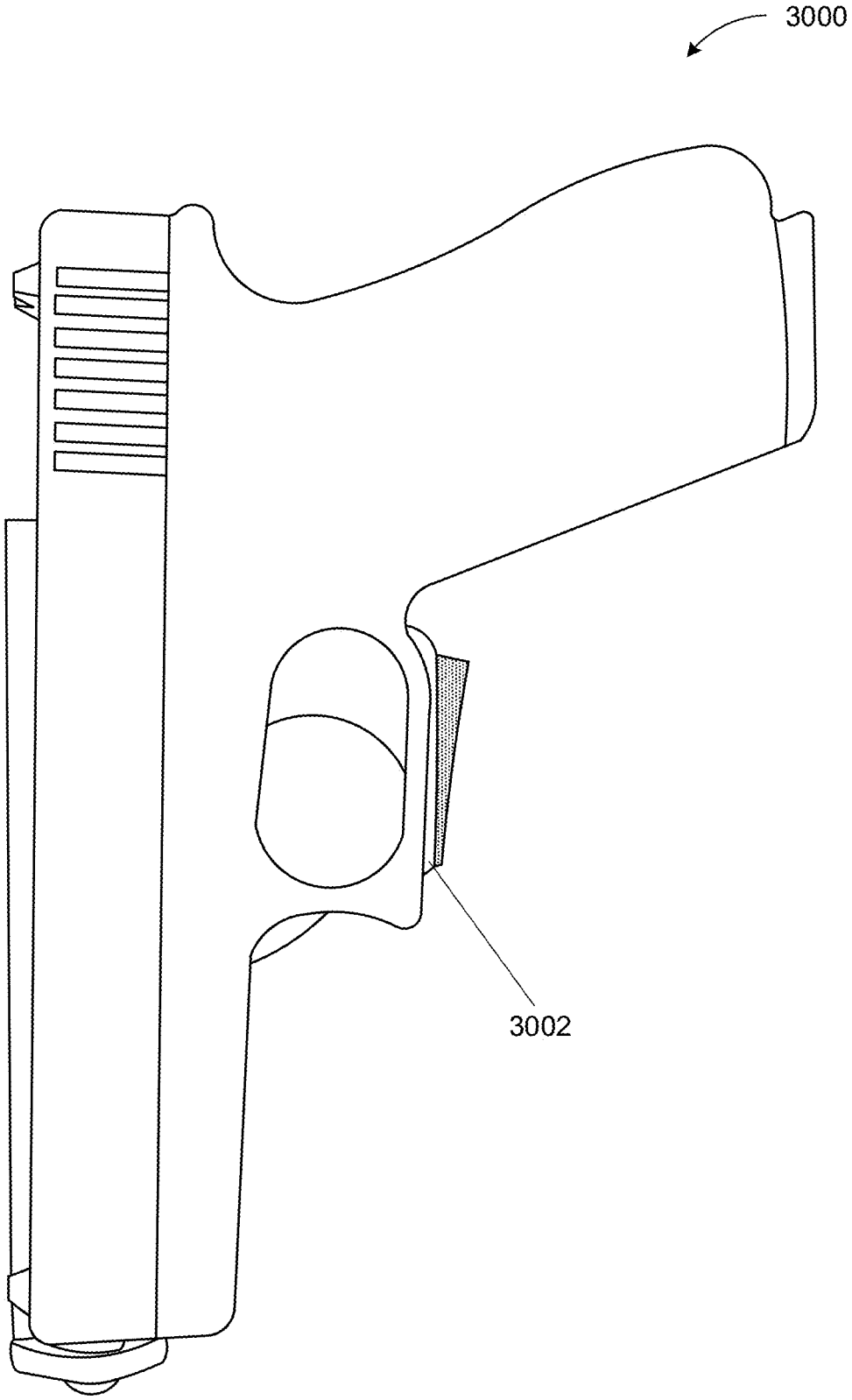
FIG. 30 shows one embodiment of the system of FIG. 27 joined to a main body and attached to a firearm.

FIG. 30 shows one embodiment of the system of FIG. 30 joined to a main body 12 and attached to a firearm. This figure shows the firearm attached to the main body, but member 102 not engaged.

Figure 31:
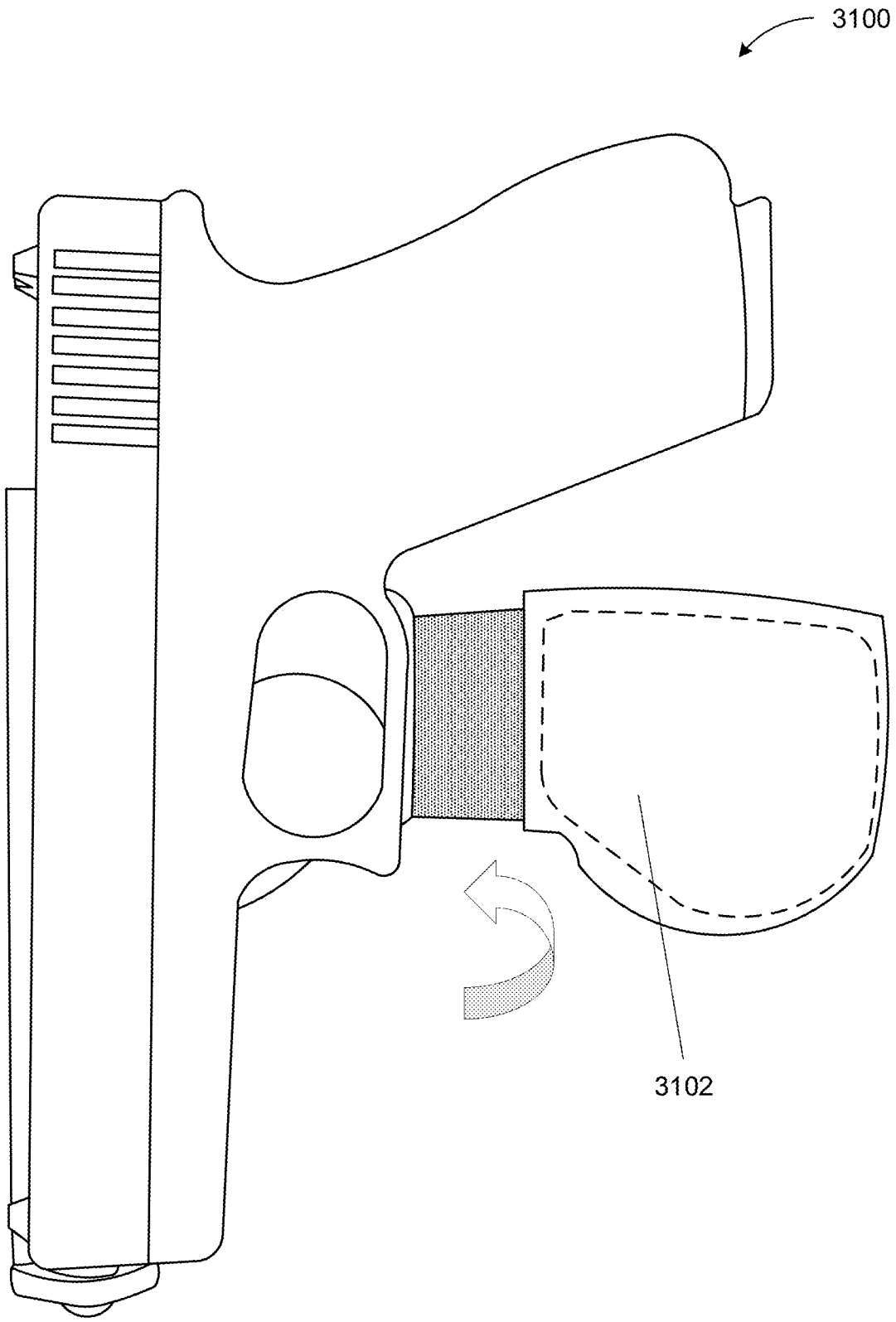
FIG. 31 shows one embodiment of a perspective view in which components are unfolded prior to pivoting the illustrated embodiment of the wrap member around to the opposing side of the firearm.

FIG. 31 shows one embodiment of a perspective view in which components 2712, 2710 are unfolded away from component 2708 prior to pivoting the illustrated embodiment of the wrap member 102 around to the opposing side of the firearm. The side opposite of the side the main body assembly 12 is positioned on. this device is not limited to these locations, and could be constructed with the main body 12 attached to varying locations around the firearm.

Figure 32:
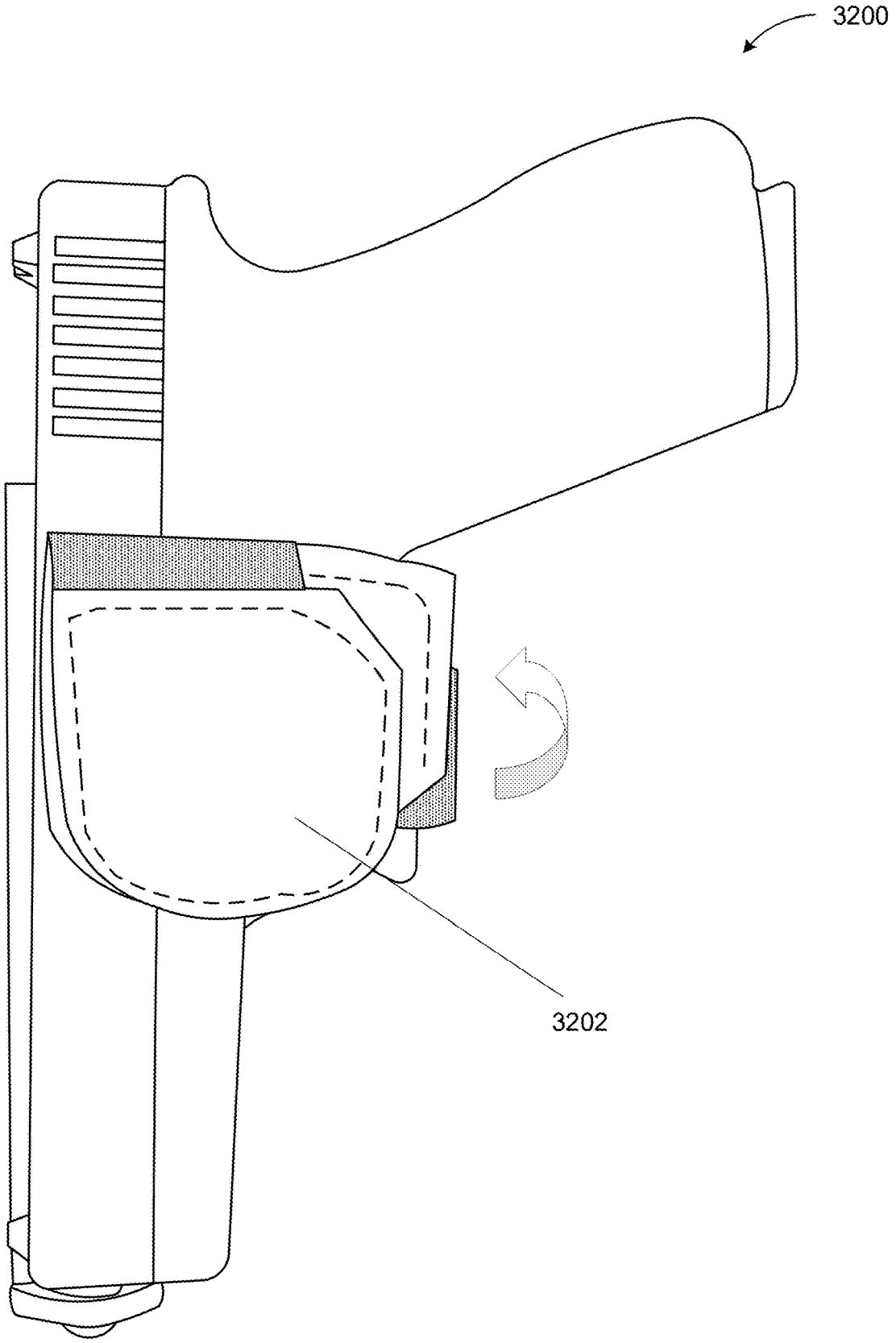
FIG. 32 illustrates one embodiment of the wrap member of FIG. 27 unfolded onto the opposing side of the firearm from which it started.

FIG. 32 illustrates one embodiment of the wrap member 102 of FIG. 30 unfolded onto the opposing side of the firearm from which it started 3202. In this figure components 2712, 2710 are now relocated on the opposite side of the firearm and opposite of component 2708. With components 2710 and 2708 together as one unit they can pivot around the firearm, avoiding protrusions from the firearm such as, but not limited to, the firearm handle. By compacting down to a smaller size, increased coverage can be achieved while maintaining the ability to clear areas of the firearm.

Figure 33:
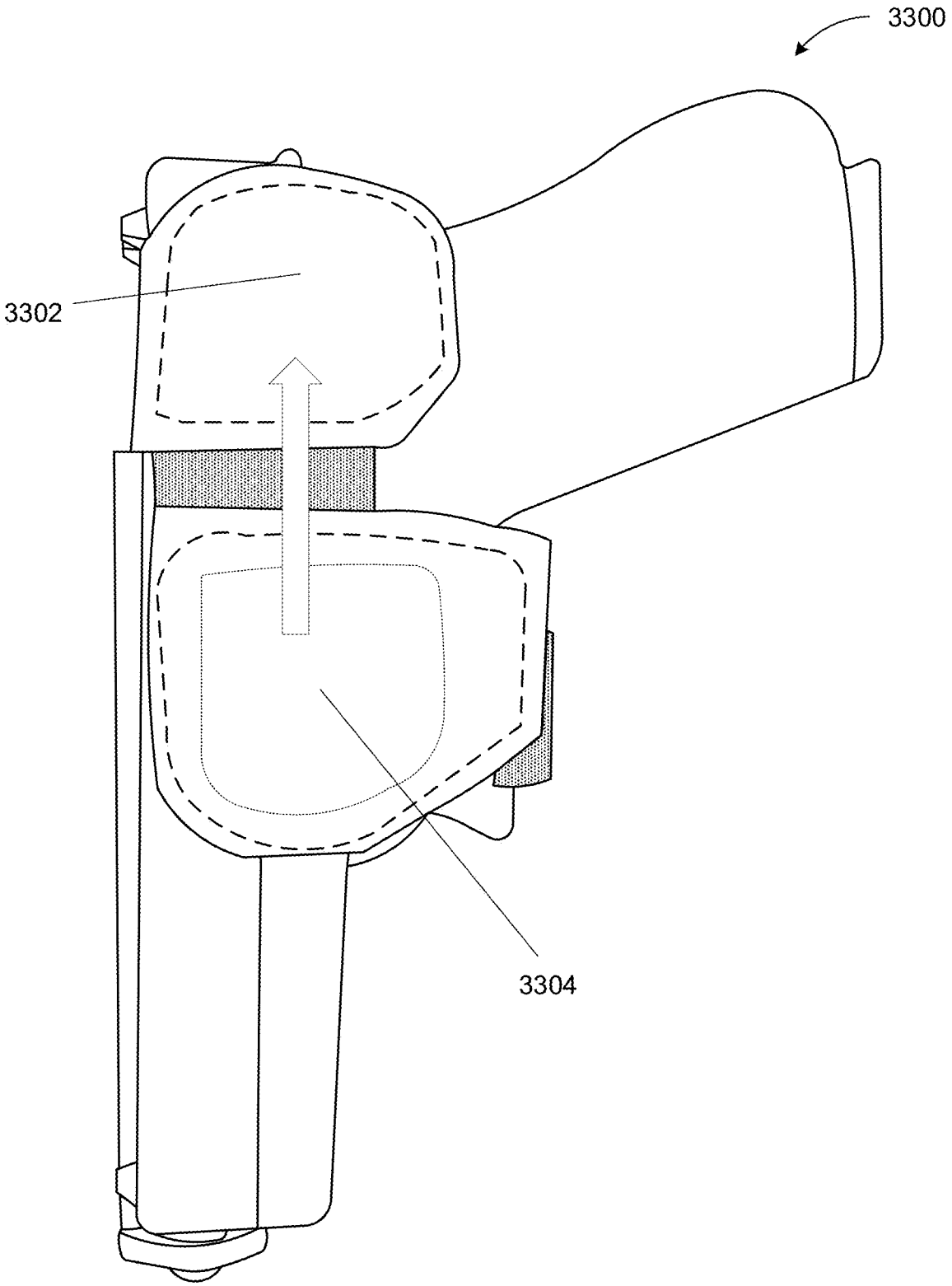
FIG. 33 shows another embodiment of the wrap member of FIG. 32 with the wrap member fully unfolded.

FIG. 33 shows another embodiment of the wrap member 102 of FIG. 32 with the wrap member 102 fully unfolded. Component 2712 can be seen unfolded and fully seated against the firearm. The unfolding motion is across the same axis as the firearm's barrel from muzzle to breach 3302. This alternative member 102 has padding installed in components 2708, 2710, and 2712, notated 3304. The particular design is not limited to having padding, and could be built without padding, or in varying locations and thicknesses.

FIG. 34 shows another embodiment of a back side view of a wrap member 102 with a holding member 3402 for preventing movement of the firearm. In this design rendition a fastener, snap, or other holding device 3502 may be disengaged prior to allowing the holding member 3402 to move. This model is not limited to the exact location of the holding member, and could be located in other areas. For example, the holding member could be positioned towards the top of the firearm, and positioned parallel with the barrel looping over the back of the firearm. The method for securing the holding member is not limited to a particular method, and could be accomplished with hook and loop, adhesives, magnets, and other locking devices.

FIG. 35 shows one embodiment of a front side view of the system of FIG. 34. In the illustrated embodiment one possible option of fastening the holding member 3402 to member 102 by sewing is shown. This holding member 3402 could be attached in other methods and is not limited to sewing. For example, rivets could be used to fasten the holding member 3402 to member 102.

Figure 36:
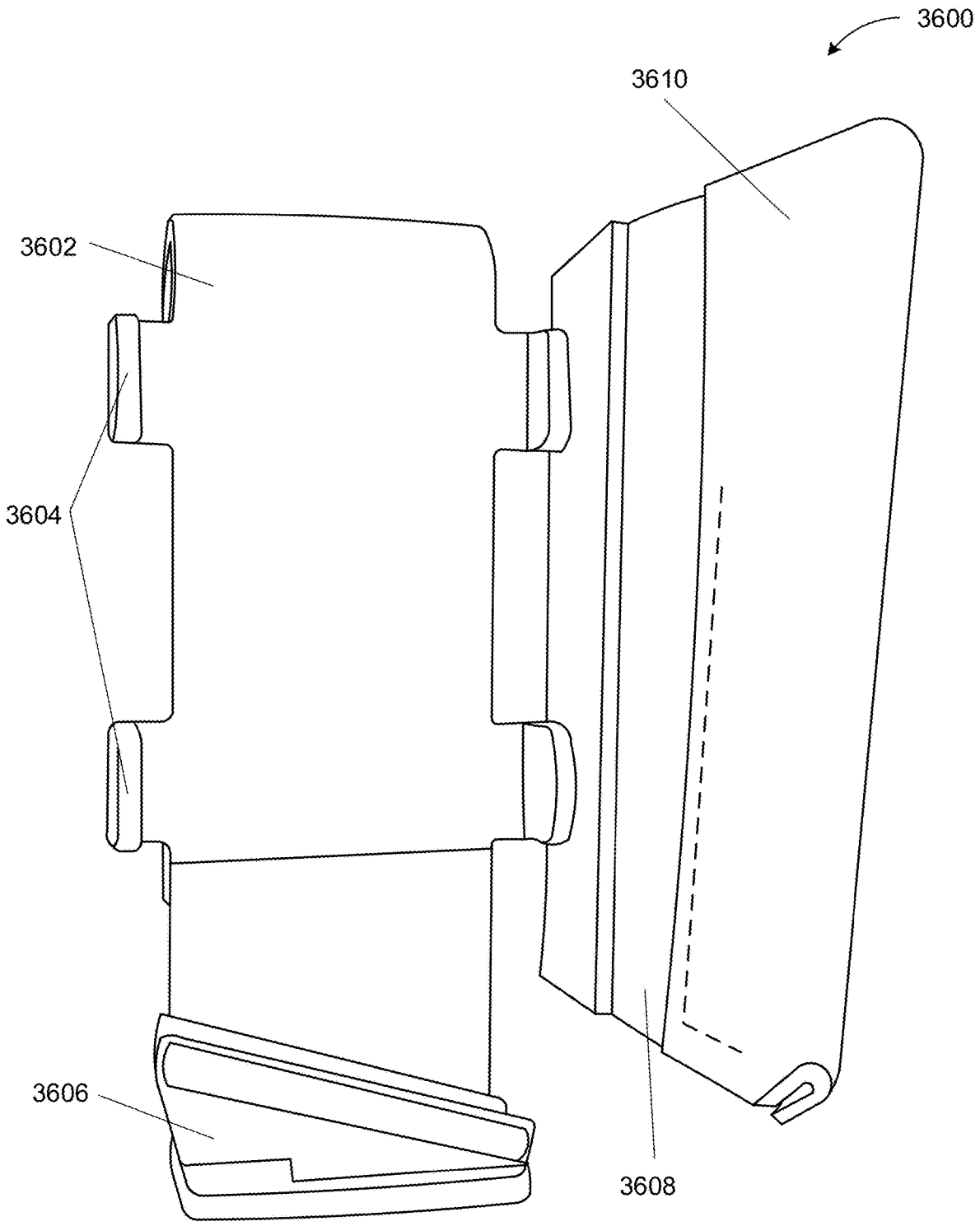
FIG. 36 illustrates one embodiment of an inside view of a component carrier adapted to carry a firearm magazine.

FIG. 36 illustrates one embodiment of an inside view of a component carrier adapted to carry a firearm magazine.

Main body 3602 shows an alternative configuration for the main body assembly 12. Extending from the main body assembly 3602 are members labeled 3604. It should be understood that members 3604 are not limited to a certain number, locations, and could be eliminated from the main body 3602. Furthermore, members 3604 are not limited to the shape or size shown. For example, members 3604 could be constructed as one rectangular component running the length of the main body 3602.

At the base of the main body 3602 is a flange with a molded insertion member 18 notated as 3606 in FIG. 36. The insertion member 3606 is not limited to being molded as one piece with the main body assembly 3602, and could be an individual component attached with adhesive, hook and loop, ultra-sonic welded, screwed, or and other attachment methods. Insertion member 3606 or the base flange could be oriented perpendicular to the main body 3602, parallel, at an acute angle, an obtuse angle, and any other possible configuration. Insertion member 3606 is intended to be inserted inside the magazine, and could be constructed in multiple variations, and not limited to the design shown. For example, the insertion member 3606 could be constructed to resemble a cartridge, or a design that has two radius components illustrated in FIG. 39 3904.

Attached to the main body 3602 is a variation of member 102 labeled 3608 in FIG. 36. This variation is attached to one side of the main body 3602 and can pivot across the main body to cover a firearm magazine or clip. Member 3608 is made of leather, but can be constructed of any material flexible or rigid, and can be made of multiple components or as one piece. For example, member 3608 and the main body 3602 could be molded as one piece, ultrasonic welded to create a solid piece, or any other construction method. A pocket 104 notated as 3610 in FIG. 36 is a location where magnets are embedded into member 3608. It should be known that the location and type of magnets used can vary, furthermore 3608 can be constructed without any magnets. For example, 3608 could be joined at member/s 3604 either in construction, or by attachment, adhesive, hook and loop, snaps, fasteners, and other attachment methods. An example of a variation of member 102 that is attached at two locations on the main body assembly 12 can be seen in FIG. 49 4202.

Figure 37:
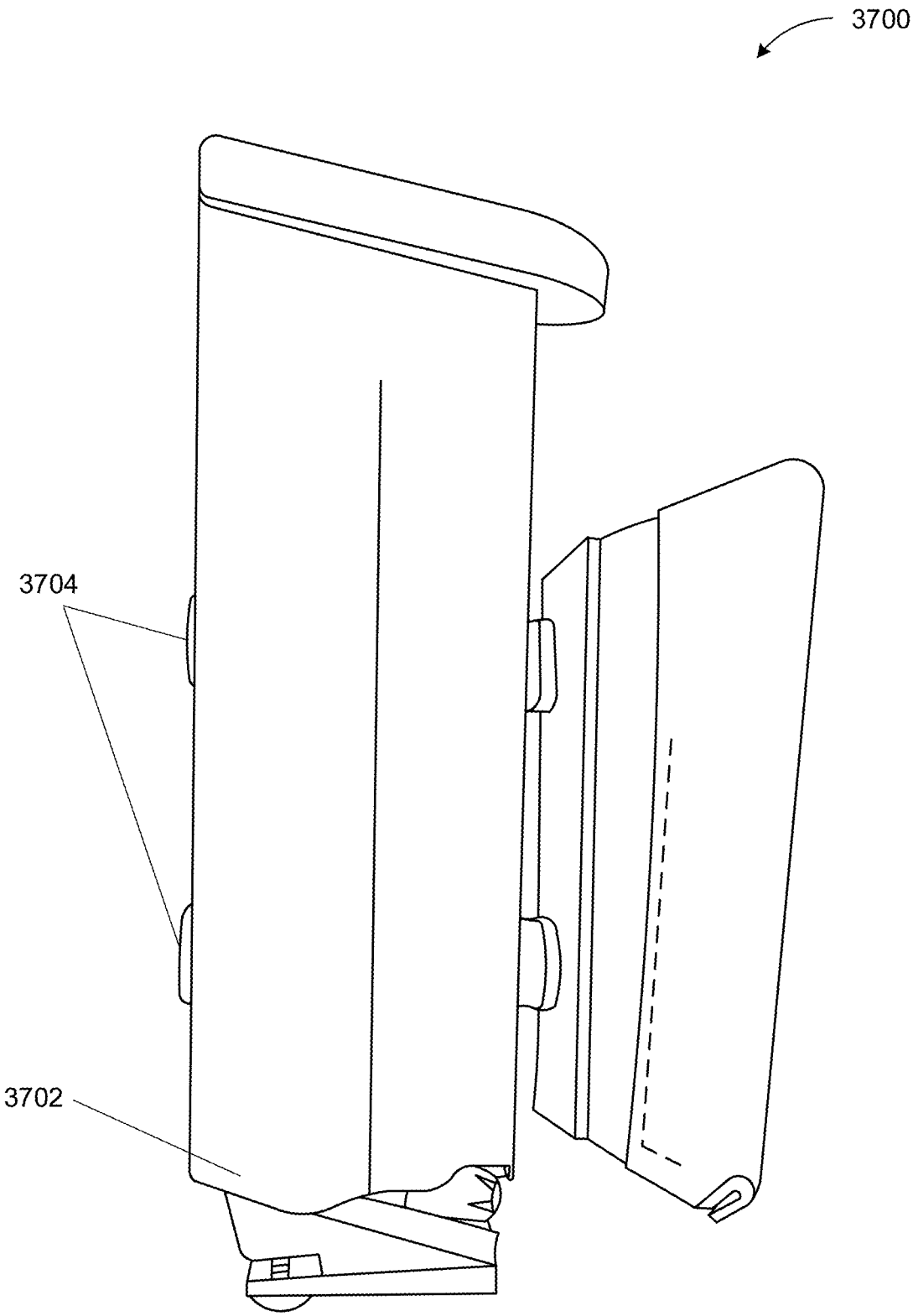
FIG. 37 shows one embodiment of a firearm component carrier with a firearm magazine installed.

FIG. 37 shows one embodiment of a firearm component carrier with a firearm magazine installed. 3702 shows the insertion member 18 notated as 3702 in FIG. 37, engaged inside the firearm magazine. The magazine is engaged with member 3702 in a sliding motion inserting member 3702 in the same manner in which a cartridge is inserted. Note the disclosed device is not limited to this insertion method. For example, member 3702 could be constructed to compress and insert into a firearm magazine with downward force parallel to the main body 3602. The magazine is shown in between member/s 3704, these members can apply force inward towards the magazine. Note member/s 3704 is not limited to applying inward force and could be built in many orientations to the main body 3602. For example, member/s 3704 could be constructed perpendicular to the main body 3602, acute, or obtuse.

Figure 38:
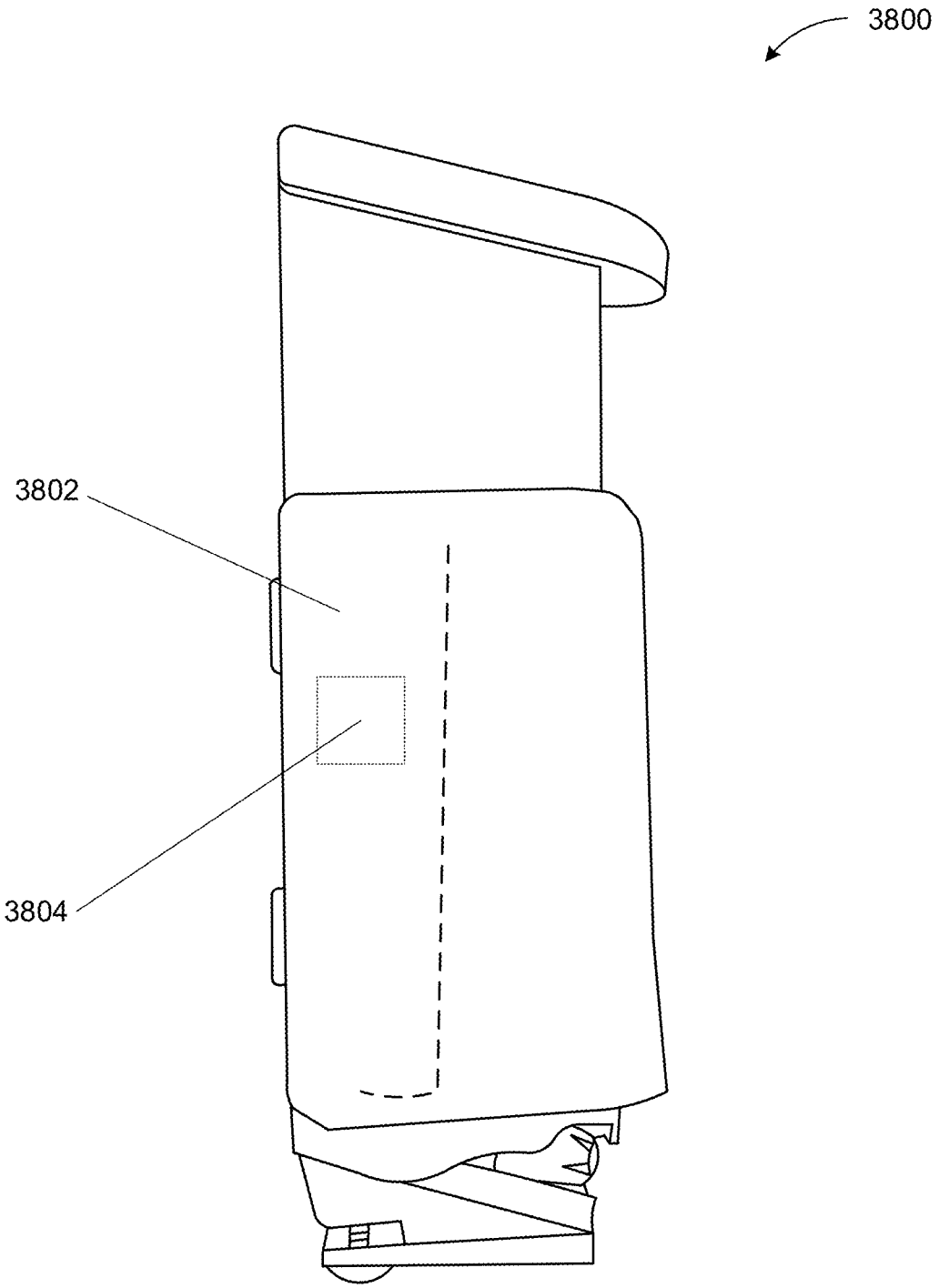
FIG. 38 shows one embodiment of a firearm magazine installed with a wrap member pivoted over the magazine.

FIG. 38 shows one embodiment of a firearm magazine installed with member 3608 pivoted over the magazine 3802. A magnet is embedded in member 3608 shown at 3804 resting against the firearm magazine. The arrow indicates the direction member 3608 has moved from its starting location shown in FIG. 37.

Figure 39:
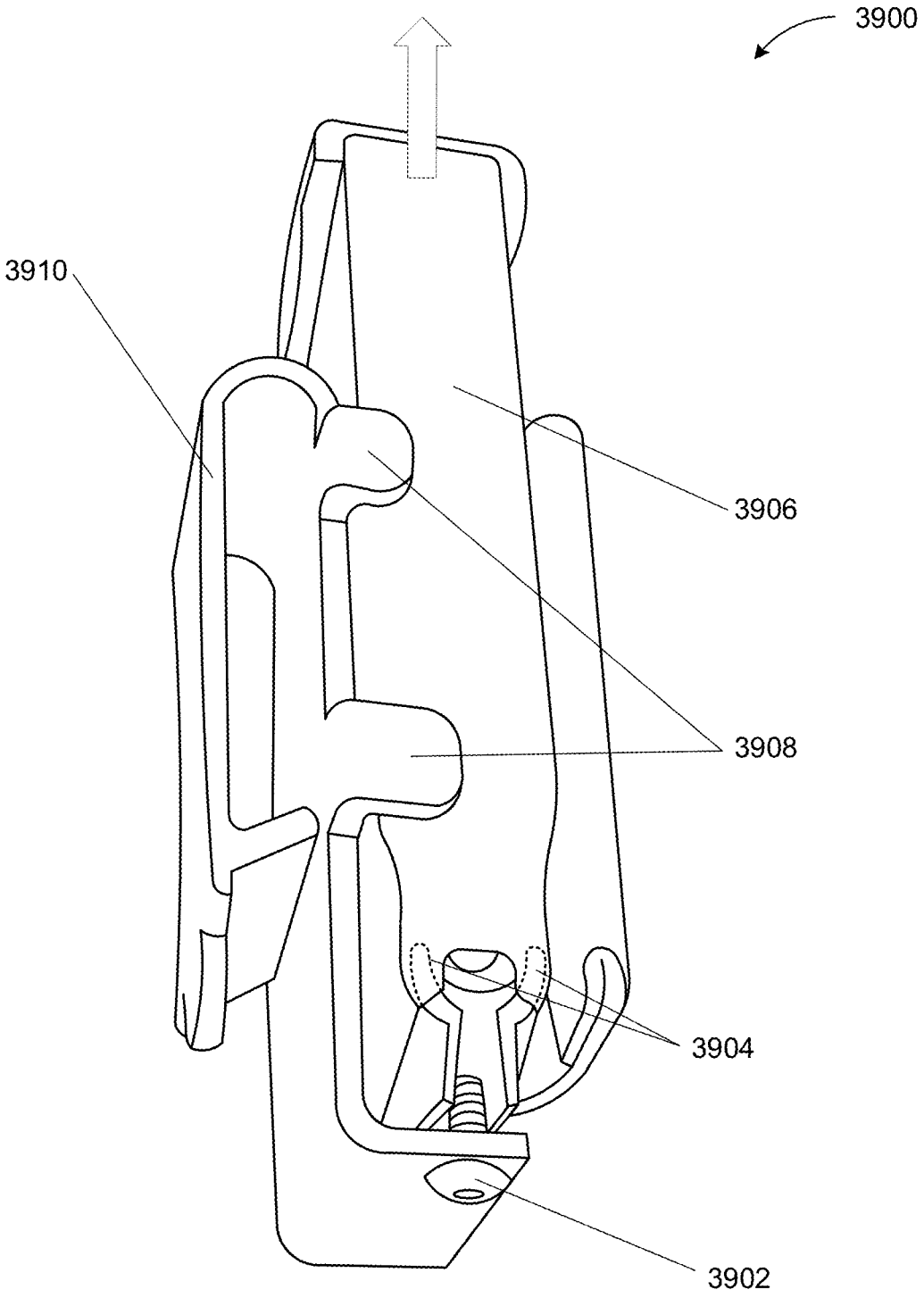
FIG. 39 illustrates one embodiment of a side view of the device of FIG. 38.

FIG. 39 illustrates one embodiment of a side view of the device of FIG. 38. The insertion member 18 notated as 3702 in FIG. 37, can be seen in a variation with a fastener attached 3902 to alter tension applied within. Fastener 3902 can vary the dimension of the insertion member 18 notated as 3702 in FIG. 40, acting as a wedge within 3702 to spread the insertion member in location 3904. 3906 marks an uncovered location on the magazine, and it should be known that member 3608 could be built in an alternative model to cover this void. For example, the member 3608 could be lengthened so that it could reach location 3906 and with a magnet adhere to location 3906. Let it be noted that member 3608 could also be joined on both sides of the main body 3602 fully covering the firearm magazine. For example, member 3608 could be joined at 3908. This disclosed device can also have an attachment point 14 notated as 3910 in FIG. 39, for securing the main body 3602 to a person's waistline, vehicle, wall, or any other desirable location to carry a firearm magazine. The attachment point 3910 could be constructed in many variations and materials, and is not limited to what is shown. For example, the attachment point 3910 could be made of metal and secured to the main body 3602 with fasteners.

Once this variation of the disclosed device is attached to a user's waistline, or any other surface, the magazine or clip can be pulled from the device, an arrow is showing on direction in which the magazine or clip can be pulled. The direction of pull is not limited to parallel with the main body 3602, but could also be pulled across any axis, or angle from the main body 3602. Upon pulling the magazine or clip, 3904 halves flex inward towards each other until they are small enough to pass through the magazine or clip.

Figure 40:
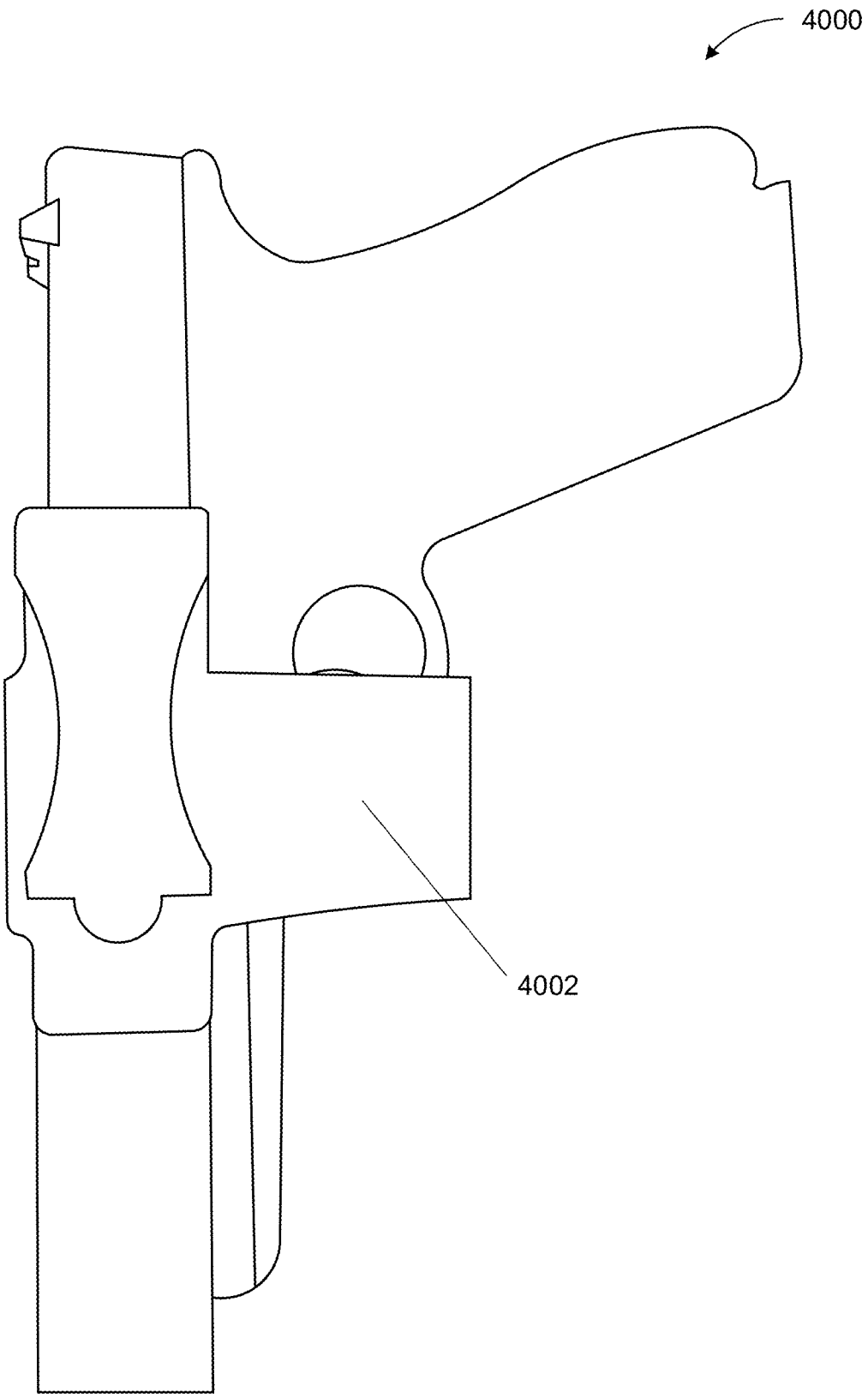
FIG. 40 shows another embodiment of a back side view of a wrap member.

FIG. 40 shows another embodiment of back side view of a wrap member 102 notated as 4002. This member 4002 is made of rigid plastic, and creates a solid structure around the firearm. Member 4002 has been molded to fit the contours of the firearm shown. Note this member 4002 is not intended to be only form fitted, and could be built in a none specific format usable across multiple firearms. Note member 4002 could also be made of materials other than plastic. Such materials could be leather, nylon, cotton, 3-D printed material, or of any combination of materials.

Figure 41:
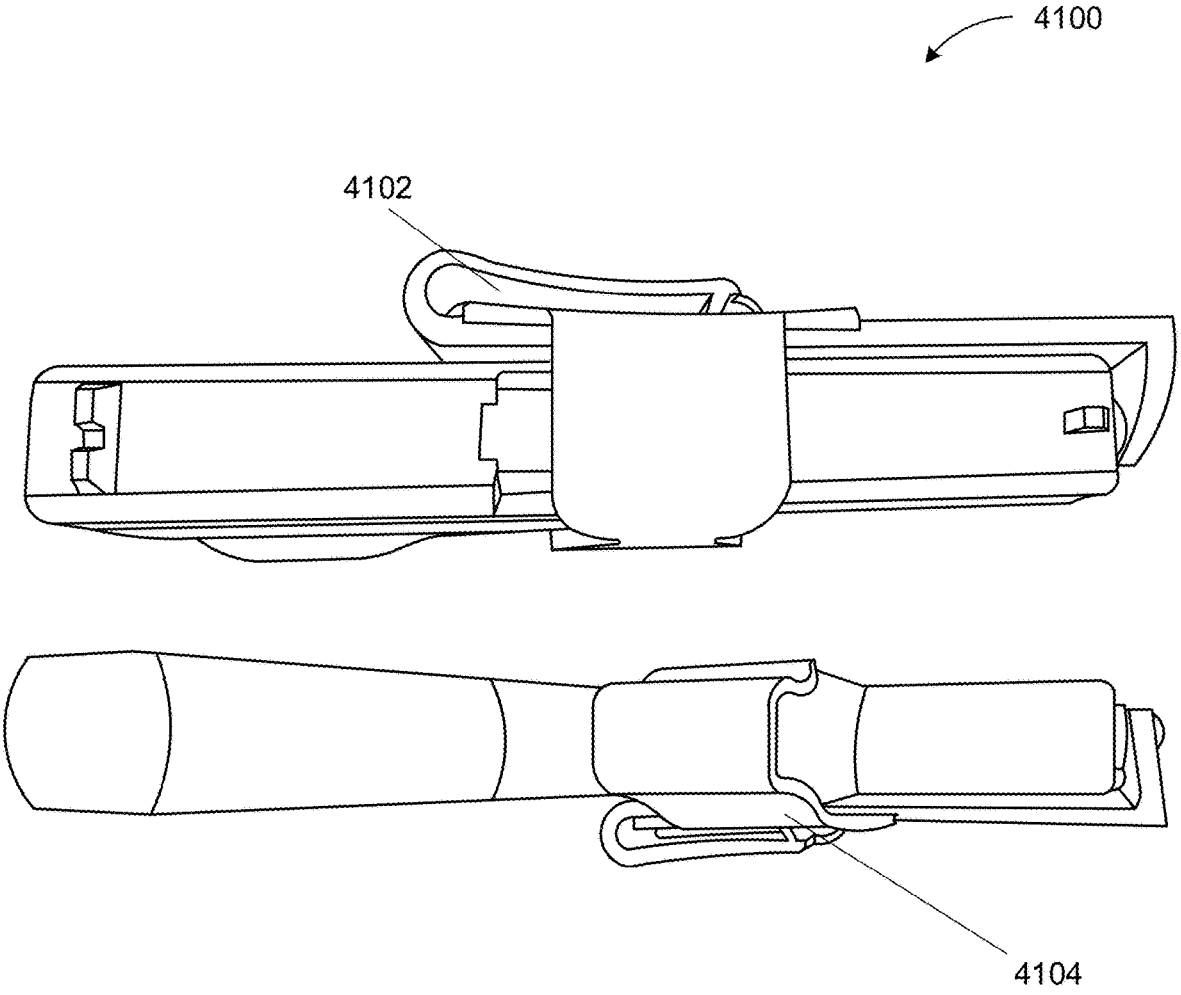
FIG. 41 illustrates embodiments of separate side views of the system of FIG. 40 installed on a firearm.

4002 FIG. 41 illustrates embodiments of separate side views of the system of FIG. 40 installed on a firearm. Note 4102 is a variation of an attachment point 14, and 4104 highlights indentations in 4002 to create a form fitting member.

Figure 42:
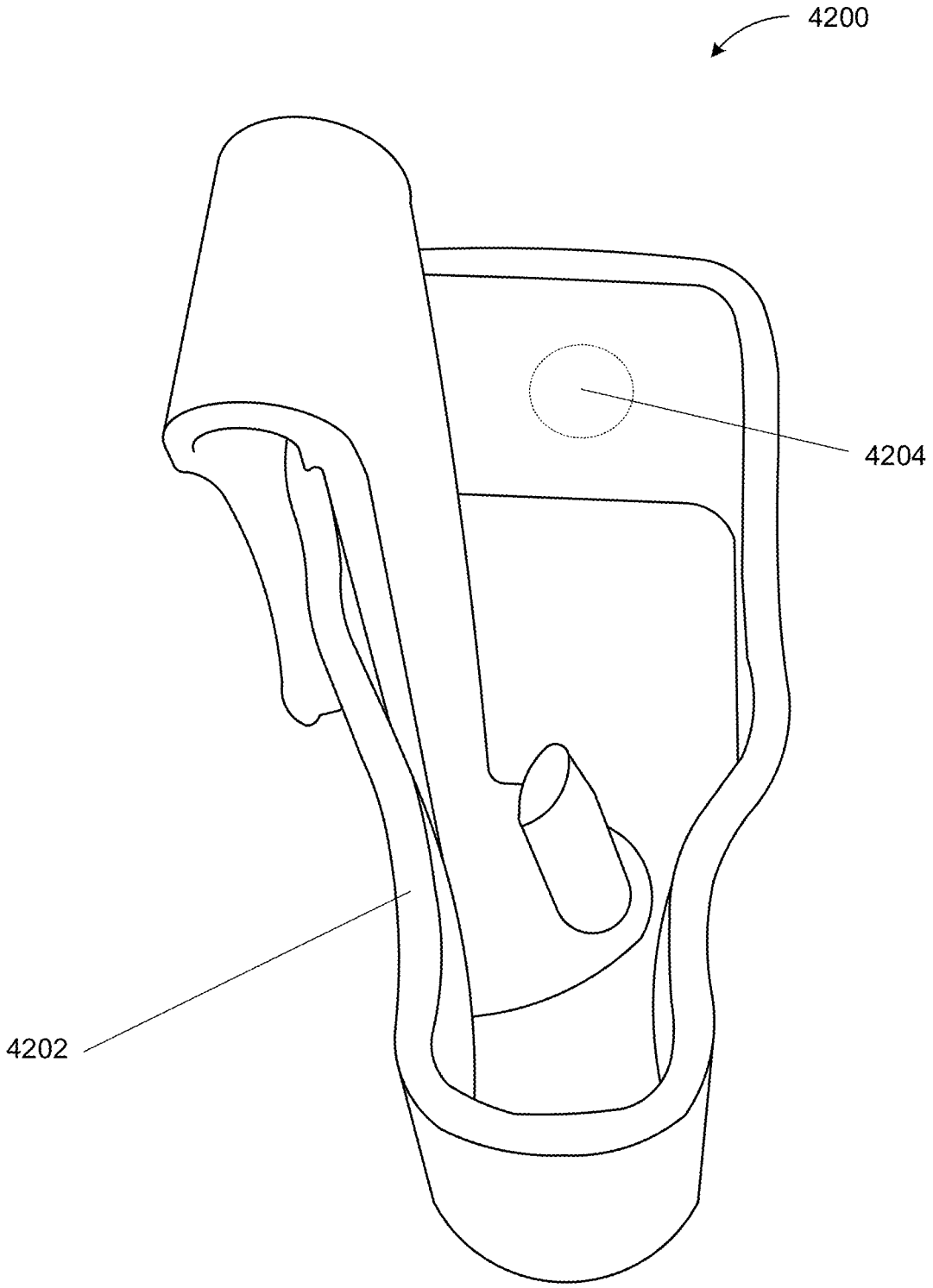
FIG. 42 shows one embodiment of a top view of a device.

FIG. 42 shows one embodiment of a top view of the device. 4202 notates the fully connected member 4002 an alternative version of member 102. this device is not limited to a fully connected member 4002. Member 4002 does not have any magnets embedded or attached, however this version is not limited to not having any magnets embedded or attached. For example, the member 4002 could have magnets molded into the section notated 4204. This version is not limited to material of construction, and could be built of plastic, nylon, elastic, neoprene, leather, 3-D printed material, and other material options.

Figure 43:
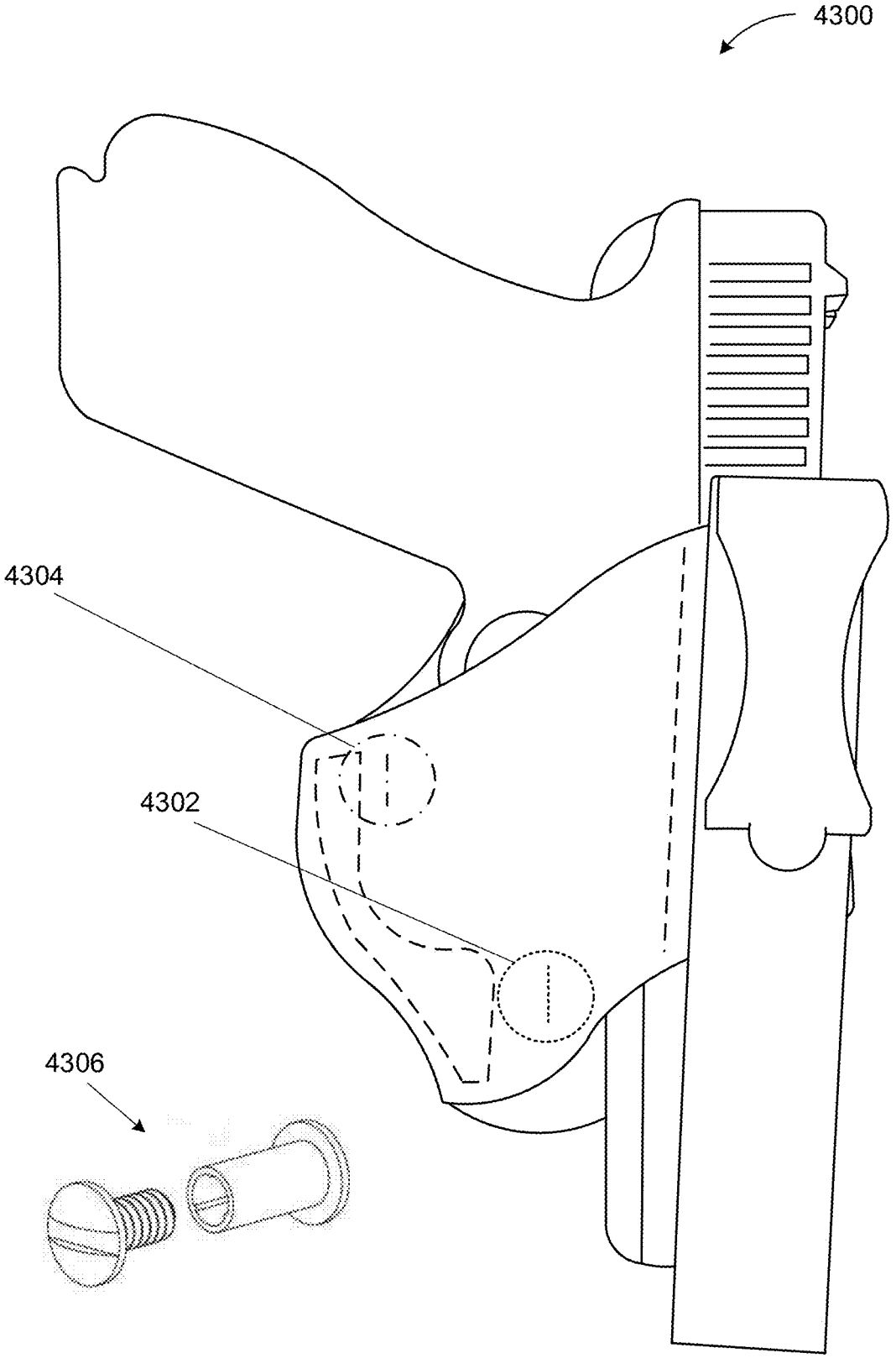
FIG. 43 illustrates another embodiment of a firearm component carrier.

FIG. 43 illustrates another embodiment of a firearm component carrier. Member 102 has been fitted with a fastener that can be adjusted inward or outward to create varying tension on the firearm being used. 4302 shows one possible location for the fastener to be located, note this is not the only location the fastener is intended to be located. For example, the fastener could be located in location 4304 or many other locations. The fastener type shown is a binding screw 4306, but let it be known the disclosed device is not limited to this type of fastener. For example, a fastener with a nut would work as well. Adjustable tension in this variation is achieve as fastener is threaded inward closing the dimension between the material halves. This could also be constructed with a compressible member between the two halves forcing the two halves outward upon unthreading the fastener. For example, a compressible member can be seen in FIG. 45 4502.

Figure 44:
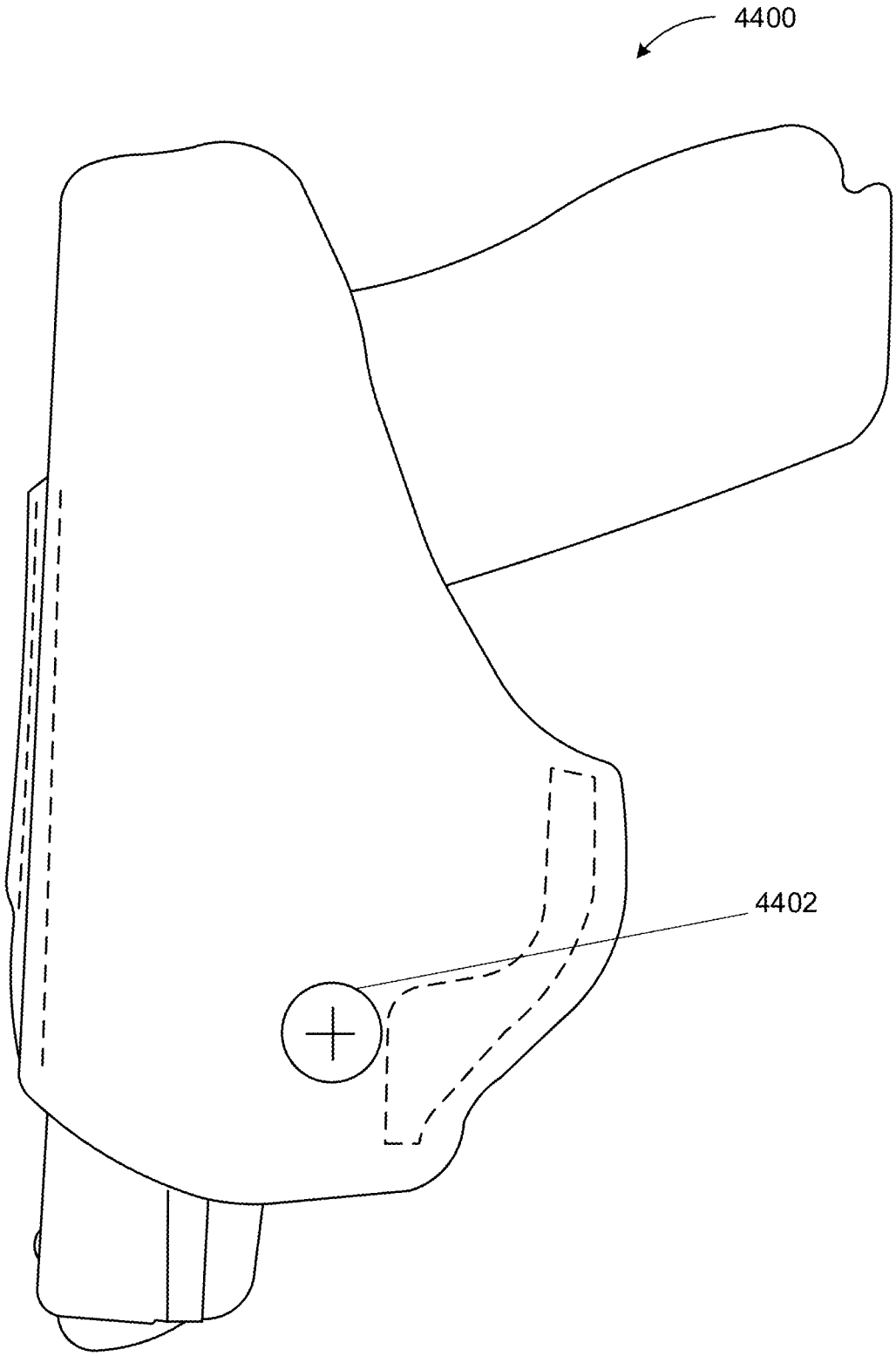
FIG. 44 shows one embodiment of a front side view of the device of FIG. 43.

FIG. 44 shows one embodiment of a front side view of the device of FIG. 43. In the illustrated embodiment, the fastener can be seen at location 4402.

Figure 45:
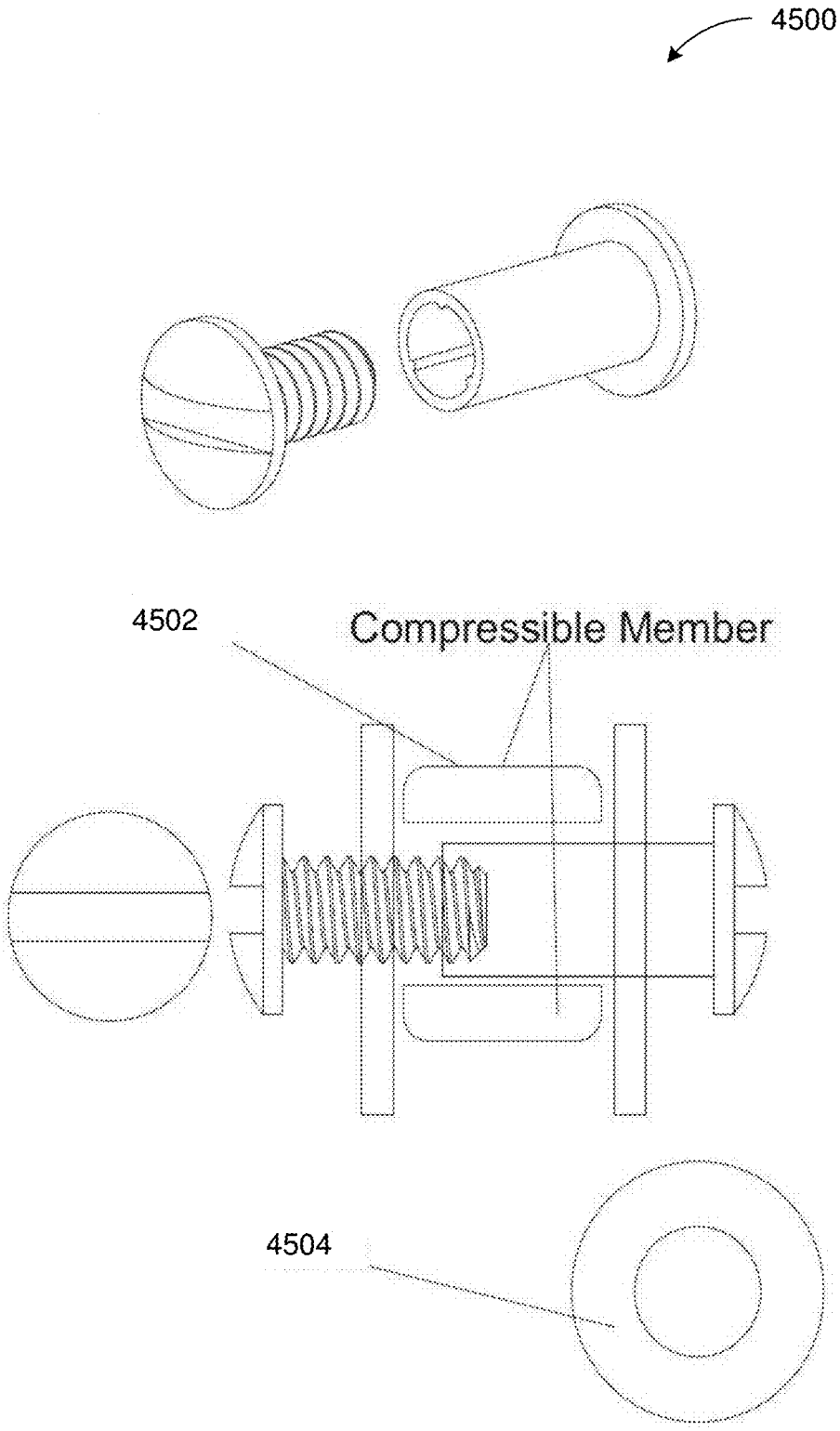
FIG. 45 illustrates one embodiment of a schematic diagram of a fastener option compatible with a wrap member.

FIG. 45 illustrates one embodiment of a schematic diagram of a fastener option compatible with a wrap member 102. An assembly of this fastener and a compression member can be seen in drawing 4502. This disclosed device is not limited to the particular orientation shown, and there are multiple ways this configuration could be constructed. One compression member option can be seen in 4504, this angle shows a circular member with a cored hole in the center. The thickness and material type of the compression member can vary. Material choices for the compression member are not limited to, but could be constructed of rubber, leather, nylon, cotton, 3-D printed material, or any other material.

While implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to." The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm carry system, the system comprising:

a main body comprising an elongate vertical portion and a flange portion extending away from the elongate vertical portion;

a wrap member coupled to the main body at a first end of the wrap member, the wrap member being flexible and shaped to wrap horizontally no more than one full revolution around a firearm; and a magnet coupled to a second end of the wrap member, the magnet arranged to slidably magnetically couple the second end of the wrap member to the firearm to secure the firearm relative to the main body, wherein the second end of the wrap member cannot be coupled to the main body other than via the coupling of the first end to the main body.

2. The system of claim 1, wherein the wrap member is at least partially rigid.

3. The system of claim 1, wherein the wrap member is at least partially flexible.

4. The system of claim 1, wherein the magnet is arranged at an edge of the wrap member to couple the wrap member to the firearm.

5. The system of claim 1, further comprising an insert member coupled to the flange portion, the insert member positioned to insert into a barrel of the firearm.

6. A firearm component carrier apparatus comprising:

a rigid main body comprising an elongate vertical portion and a flange portion extending away from the elongate vertical portion;

an insert member coupled to the flange portion and oriented to insert into a barrel of a firearm component, the insert member oriented at a fixed angle relative to the main body;

a wrap member coupled to the main body at a first end of the wrap member and free relative to the main body at a second end of the wrap member, the wrap member being flexible and shaped to wrap horizontally no more than one full revolution around the firearm component, from a first side of the firearm component around a second side of the firearm component opposite the first side, and to secure the firearm component relative to the main body; and a magnet disposed in the second end of the wrap member, the magnet configured to slidably magnetically couple the second end of the wrap member to the firearm component, wherein the second end of the wrap member cannot be coupled to the main body other than via the coupling of the first end to the main body.

7. The apparatus of claim 6, wherein the firearm component is a pistol.

8. The apparatus of claim 6, wherein the firearm component is an ammunition component.

9. The apparatus of claim 8, wherein the insert member is shaped to interface with the ammunition component.

10. The apparatus of claim 6, wherein the main body comprises an attachment feature shaped to attach the main body to a structure.

11. The apparatus of claim 6, wherein the insert member is shaped to interface with a portion of the firearm component.

12. The apparatus of claim 6, wherein the insert member is oriented parallel to the main body.

13. The apparatus of claim 6, wherein the magnet is positioned on the wrap member to engage with a magnetic portion of the firearm component to magnetically couple the wrap member to the firearm component.

14. A firearm component holster comprising:

a rigid main body comprising an elongate vertical portion, a fastening device coupled to a first end of the elongate vertical portion, and a flange portion extending away from a second end of the elongate vertical portion, opposite the first end;

an insert member coupled to the flange portion and oriented at a fixed angle relative to the main body; and a wrap member coupled to the elongate vertical portion of the main body at a first end of the wrap member between the first end and the second end of the main body, the wrap member shaped to wrap horizontally no more than one full revolution around the firearm component, and comprising a magnet disposed in a second end of the wrap member to slidably magnetically engage with the firearm component to magnetically couple the second end of the wrap member to the firearm component to secure the firearm component relative to the main body, wherein the second end of the wrap member cannot be coupled to the main body other than via the coupling of the first end to the main body.

15. The firearm component holster of claim 14, wherein the insert member is parallel to the elongate vertical portion of the main body.

16. The firearm component holster of claim 14, wherein the wrap member comprises at least one flexible portion.

17. The firearm component holster of claim 14, wherein the wrap member comprises at least one rigid portion.

18. The firearm component holster of claim 14, wherein the wrap member couples to a joint member, the joint member having a geometry to couple the wrap member to the elongate vertical portion of the main body.

* * * * *